US007561936B2

(12) United States Patent
Matsufuji

(10) Patent No.: US 7,561,936 B2
(45) Date of Patent: Jul. 14, 2009

(54) METHOD FOR PLANNING CONSTRUCTION OF BRICK WALL

(75) Inventor: Yasunori Matsufuji, Fukuoka (JP)

(73) Assignee: Japan Science and Technology Agency, Kawaguchi-shi, Saitama (JP)

( * ) Notice: Subject to any disclaimer, the term of this patent is extended or adjusted under 35 U.S.C. 154(b) by 654 days.

(21) Appl. No.: 10/522,676

(22) PCT Filed: Jul. 31, 2003

(86) PCT No.: PCT/JP03/09730

§ 371 (c)(1),
(2), (4) Date: Jan. 31, 2005

(87) PCT Pub. No.: WO2004/011784

PCT Pub. Date: Feb. 5, 2004

(65) Prior Publication Data

US 2005/0252118 A1 Nov. 17, 2005

(30) Foreign Application Priority Data

Jul. 31, 2002 (JP) ..... 2002-223353

(51) Int. Cl.
*E04C 5/08* (2006.01)

(52) U.S. Cl. ..... 700/98; 52/606

(58) Field of Classification Search ..... 700/145, 700/97, 197, 117, 83; 52/600, 606, 585.1, 52/285.2, 747.1, 223.7
See application file for complete search history.

(56) References Cited

U.S. PATENT DOCUMENTS 3,571,931 A * 3/1971 Williams ..... 33/407
4,823,528 A * 4/1989 Faw ..... 52/233
6,282,859 B1 * 9/2001 Van Der Heijden ..... 52/585.1
6,557,316 B2 * 5/2003 Van Der Heijden ..... 52/585.1
6,662,490 B1 * 12/2003 Aesch, Jr. ..... 43/124
6,915,614 B2 * 7/2005 Matsufuji ..... 52/600
7,111,437 B2 * 9/2006 Ainedter ..... 52/749.14
2002/0032546 A1 3/2002 Imamura et al.
2005/0044133 A1 * 2/2005 Hashimoto et al. ..... 709/201

FOREIGN PATENT DOCUMENTS

EP 1047021 A 10/2000
JP 62-80915 U 5/1987

(Continued)

*Primary Examiner*—Kidest Bahta
(74) *Attorney, Agent, or Firm*—Jacobson Holman PLLC

(57) ABSTRACT

A method for planning the construction of a brick wall, a brick allocating program, and a brick allocating system for allocating bricks, metal plates, and bolts and nuts in a DUP construction method is provided, in which a grid pattern XY coordinate system forming square grids is specified, and odd number layer tightening grids (α) and even number layer tightening grids (β) are alternately set in X- and Y-directions. The brick (10) of an end part of the wall is positioned on a reference grid (γ) so that a first square half part of the brick having a bolt hole (30) matches the odd or even number layer tightening grid. The bricks of the odd or even number layer are successively arrayed from the reference grid, and the metal plates are disposed in such a manner that at least one bolt hole (53) of the metal plate (50) is located on the odd or even number layer tightening grids.

16 Claims, 18 Drawing Sheets

FOREIGN PATENT DOCUMENTS

| | | | |
|---|---|---|---|
| JP | 05-255982 | A | 10/1993 |
| JP | 06-299621 | A | 10/1994 |
| JP | 07-229215 | A | 8/1995 |
| JP | 09-021199 | A | 1/1997 |
| JP | 09-235801 | A | 9/1997 |
| JP | 2002-061227 | A | 2/2002 |
| JP | 2002-081152 | A | 3/2002 |
| WO | WO 02/20913 | A1 | 3/2002 |

* cited by examiner (A)

(B)

(A)

(B)

(C)

(A)

(B)

(A)

(B)

METHOD FOR PLANNING CONSTRUCTION OF BRICK WALL

This is a nationalization of PCT/JP03/009730 filed Jul. 31, 2003 and published in Japanese.

BACKGROUND OF THE INVENTION

1. Field of the Invention

The present invention relates to a method for planning construction of a brick wall, and more specifically, to such a method used for constructing a brick wall by a dry type of bricklaying construction method in which vertically adjacent bricks are integrally assembled under pre-stress.

2. Related Art

A variety of building construction methods are known in the art, such as wooden, reinforced concrete, steel and block masonry construction methods. As a kind of such construction methods, a bricklaying method is known, in which a wall structure is constructed by bricklaying. Bricks produced by baking brick clay at a high temperature are evaluated high by their architectural design effects or aesthetic effects resulting from their textures, stately appearances, feelings, colors and so forth. The bricks also exhibit their excellent physical performances with respect to durability, sound insulation effect, fire resistance efficiency, heat accumulation effect and so forth. Therefore, the bricks have been popularly used worldwide for a long time and widely employed as materials for architectural wall structures.

The present inventor has proposed DUP (Distributed and Unbonded Prestress) construction method as a dry type of bricklaying construction method. This construction method is known as an earthquake resistant bricklaying construction method in which bricks are stacked in a multi-layered condition while pre-stress is introduced into the bricks by tightening forces of metallic bolts. Studies for practical applications thereof is still continued (Japanese patent applications Nos. 4-51893, 5-91674, 6-20659, 7-172603 and 8-43014 (Japanese patent laid-open publications Nos. 5-255982, 6-299621, 7-229215, 9-21199 and 9-235801)).

With respect to the such a bricklaying construction method, the present inventor has proposed the method in which a bolt hole, a large diameter hollow section and semicircular grooves on end faces are formed in position of a brick so that various intricate parts of wall structures can be constructed by a common type of bricks, in Japanese patent application No. 2000-270219 (Japanese patent laid-open publication No. 2002-81152) and Japanese patent application No. 2002-61227.

The dry type of bricklaying construction method as set forth above is a dry construction method in which a brick wall is constructed by tightening forces of bolts and nuts, and this method has achieved an intended purpose, such as considerable reduction of time of construction period, in comparison with a conventional wet type of bricklaying construction method. On the other hand, in this construction method, it is necessary to optimize not only allocations of bricks but also allocations of metal plates, bolts and nuts in each of the brick layers, because the structure is arranged so that the strength of wall depends on the tightening torque of the bolt and nut which is transmitted as a stress to the brick through the metal plate. Accordingly, the allocations and the arrangements of bricks, plates, bolts and nuts in plans and elevations, and the like, should be accurately and promptly determined before construction or during construction, in order to make elevations of brick allocations, plans of allocations of brick and plate in regard to each of layers, and so forth. However, an allocating rule for systemizing and optimizing layout of the bricks, the metal plates, and the bolts and nuts in the DUP construction method has not yet been established, and therefore, construction planning method for establishing the rule is desired to be developed.

Further, the walls of building includes not only regular and straight wall structures but also peculiar configurations or irregularly deformed parts, such as ends, corners and connections of wall structures, openings of windows or doors, external or internal corners of partition walls, and so forth. Therefore, it is necessary to produce various plates, taking such irregular parts into consideration. For this reason, it is difficult to prepare and stock the plates beforehand, and the construction period in the construction site may be affected by a term of time (days) for manufacture of the plates, timing of an order of the plates, or the like.

Furthermore, since the bolts and nuts are positioned at vertical joints in the conventional bricklaying method, it is necessary to surely isolate the bolts and nuts from outdoor air and ensure rustproofing, weatherproofing, fireproofing and the like for the bolts and nuts and their surrounding structures. In order to omit or simplify such additional treatments, it is desired to adopt a design in which the bolts and nuts can be entirely contained in the bricks without the bolts and nuts being positioned at the vertical joints and in which tightening forces of bolts and nuts can be uniformly distributed over the whole wall so as not to make structural weak points. However, it is difficult to perform such a design in the bricklaying construction method in which the layout plans of bricks and plates are required for each of the layers as set forth above, and therefore, development of construction planning method is desired for performing such a design simply, promptly and systematically.

It is an object of the present invention to provide a method for planning the construction of the brick wall based on the DUP construction method, which can accurately, promptly and systematically determine the allocations of the bricks, the plates and the bolts and nuts before construction or during construction for constructing and arbitrary a brick wall with use of a few standardized types of plates, which allows the bolts and nuts to be contained in the bricks, and which allows the tightening forces of the bolts and nuts to be distributed uniformly throughout the overall walls.

It is another object of the present invention to provide a brick allocating program and a brick allocating system for realizing such a method for planning construction of the brick wall.

SUMMARY OF THE INVENTION

In accordance with the above objects, the present invention provides a method for planning construction of the brick wall based on the DUP construction method, which can accurately, promptly and systematically determine the allocations of the bricks, the plates and the bolts and nuts before construction or during construction for constructing an arbitrary brick wall with use of a few standardized types of plates, which allows the bolts and nuts to be contained in the bricks, and which allows the tightening forces of the bolts and nuts to be distributed uniformly throughout the overall walls.

Further, the present invention provides a brick allocating program and a brick allocating system for realizing such a method for planning construction of the brick wall.

More specifically, the present invention provides a method for planning construction of a brick wall made by a dry type of construction method, in which the brick wall are constructed from bricks, bolts, nuts and metal plates and in which the bricks are integrally assembled under pre-stress by tightening forces of the bolts and nuts, wherein the brick has a planar dimensional proportion which is 1:2 in an aspect ratio, a bolt hole with a diameter smaller than an external diameter of said nut vertically extends through a center of a first square half part of said brick, a hollow section for containing the nut vertically extends through a center of a second square half part of said brick, and said bolt has an overall length for fastening the vertically adjacent two bricks, comprising the steps of:

specifying a grid pattern XY coordinate system forming a number of square grid units, each of the grid units substantially conforming to a planar size of the square half part of said brick, and setting odd number layer tightening grids ($\alpha$) and even number layer tightening grids ($\beta$) alternately in each of X- and Y-directions;

setting an arbitrary grid unit, to which an end part of the brick wall is allotted, to be a reference grid ($\gamma$);

positioning the brick of the end part of the brick wall on said reference grid for allocating the bricks in the odd number layer so as to match said first square half part to said odd number layer tightening grid, and successively arraying the bricks of the odd number layer from the brick on the reference grid, as well as positioning the brick of the end part of the brick wall on said reference grid for allocating the bricks in the even number layer so as to match said first square half part to said even number layer tightening grid, and successively arraying the bricks of the even number layer from the brick on the reference grid; and arraying said metal plates for allocation of the plates on the bricks of said odd number layer so that at least one bolt hole of the plate is positioned on said odd number layer tightening grid, as well as arraying the metal plates for allocation of the plates on the bricks of said even number layer so that at least one bolt hole of the plate is positioned on said even number layer tightening grid.

In the brick wall made by the DUP construction method, the brick has a particular planar size (the aspect ratio is 1:2). At the center of each half part of the brick, one of the bolt hole or the hollow section is located. In the brick wall made by the DUP construction method, the bolt can be set to have an overall length for tightening vertically adjacent two bricks and the tightening positions of the nuts can be positioned elevationally alternately and systematically. According to such regularity and particularity of the DUP construction method, when the half part of the brick is recognized as one unit (unit square) of a grid pattern (grid) in a plan, the grid unit of the even number brick layer immediately under or above the grid unit of the odd number brick layer indicates a position unnecessary for tightening the nut if the grid unit of the odd number brick layer indicates a position necessary for tightening the nut, and vice versa. Therefore, if a grid plan is specified and the end part (or a corner) of a brick wall is allotted to an arbitrary grid in the grid plan, the allocation of bricks can be systematically determined for the entire building. In addition, as the bolt hole of the metal plate corresponds to the bolt hole of the brick immediately below the metal plate, the allocation of metal plates in the respective layers can be systematically determined in association with the allocation of the bricks in the respective layers.

Thus, according to the aforementioned method of planning construction of the brick wall, it is possible to accurately, promptly and systematically determine the allocations of the bricks, the plates, and the bolts and nuts with use of technologies of electronics and information processing, such as computers, electronic devices and circuits. Further, since the allocation of the metal plates can be also systematically carried out, the metal plates can be also standardized beforehand in correspondence to the allocation rule of the bricks. Therefore, the brick walls can be constructed with use of a few types of standardized metal plates previously manufactured or stocked. Furthermore, according to the aforementioned method, the bolts and nuts are contained in the bricks without being located at the joint parts of the bricks, so that the bolts and nuts are isolated from the external environment. Therefore, durability and fire resistance of the bolts and nuts can be improved. In addition, the bolts and nuts are uniformly disposed to the overall brick walls, and therefore, the tightening forces of the bolts and nuts are uniformly distributed over the whole brick wall.

From another aspect of the present invention, a brick wall of a building is provided, which is constructed on the basis of the brick allocation and the plate allocation, and the bolts and nuts are contained in the bolt holes and the hollow sections.

The present invention also provides a brick allocating program for causing a computer to function so as to make a brick layout drawing for construction of a brick wall with respect to the brick wall made by a dry type of construction method, in which the brick walls are constructed from bricks, bolts, nuts and metal plates and in which the bricks are integrally assembled under pre-stress by tightening forces of the bolts and nuts, wherein the program causes the computer to function as:

grid coordinate system display means for displaying on a display, a grid pattern XY coordinate system constituted from square grids, each corresponding to the planar size of a square half part of the brick;

brick allocation model production means for producing brick allocation model data of an odd number layer and an even number layer which are adapted for said grids, based on information of a wall structure and an opening on an architectural design drawing inputted to said coordinate system;

brick layout drawing data production means for automatically producing brick layout drawing data from said brick allocation model data; and drawing data output means for outputting said brick layout drawing data as a working drawing for construction.

The computer controlled by the brick allocating program specifies the grid pattern XY coordinate system which defines the square grids, and sets the odd number layer tightening grids (a) and the even number layer tightening grids ($\gamma$) alternately in each of X- and Y-directions. The set dimensions of the square unit in the grids substantially conform to the planar dimensions of a square half part of the brick. Preferably, an arbitrary grid on the XY coordinate system is set to be a reference grid (Y). The brick of the end part of the brick wall is positioned on the reference grid so that the aforementioned first square half part matches with the odd number layer tightening grid, whereby the bricks for the odd number layer can be successively arrayed from the brick on the reference grid. Further, the brick of the end part of the brick wall is positioned on the reference grid so that the aforementioned first square half part matches with the even number layer tightening grid, whereby the bricks for the even number layer can be successively arrayed from the brick on the reference grid. The computer can automatically allocate the metal plates for the odd number layer by positioning at least one bolt hole of the plate on the odd number tightening grid. Also, the computer can automatically allocate the metal plates for the even number layer by positioning at least one bolt hole of the plate on the even number tightening grid. The program as set forth above may be arranged to automatically estimate quantities of the bricks, the bolts, the nuts and the metal plates, based on the number of grids locating along the brick wall.

The present invention further provides a brick allocating system for making a brick layout drawing for construction of a brick wall with respect to the brick wall made by a dry type of construction method, in which the brick walls are constructed from bricks, bolts, nuts and metal plates and in which the bricks are integrally assembled under pre-stress by tightening forces of the bolts and nuts, comprising:

a display device for displaying a grid pattern XY coordinate system constituted from square grids, each corresponding to a planar size of a square half part of the brick;

an input device for inputting information of a wall structure and an opening on an architectural design drawing to said XY coordinate system;

a data processing device producing brick allocation model data for an odd number layer and an even number layer, which are adapted for the grids, and automatically producing brick layout drawing data based on said brick allocation model data;

a storage device for storing said brick allocation model data and said brick layout drawing data; and an output device for outputting said brick layout drawing data as a working drawing for construction.

According to a preferred embodiment of the present invention, the aforementioned metal plate has two, three, four or five bolt holes, which are spaced from each other, a distance corresponding to the planar dimension of the aforesaid square half part. The metal plate is disposed so as to extend over at least two bricks. The nuts for the bricks of the odd number layer are allotted to the bolt holes of the metal plates located on the odd number layer, whereas the nuts for the bricks of the even number layer are allotted to the bolt holes of the metal plates located on the even number layer. Preferably, a corner part of an outer brick wall located on a corner of building is allotted to an arbitrary grid in the XY coordinate system, so that the aforesaid reference grid ($\gamma$) is determined.

DETAILED DESCRIPTION OF THE PREFERRED EMBODIMENTS

With reference to the attached drawings, preferred embodiments of the present invention are described hereinafter.

Figure 1:
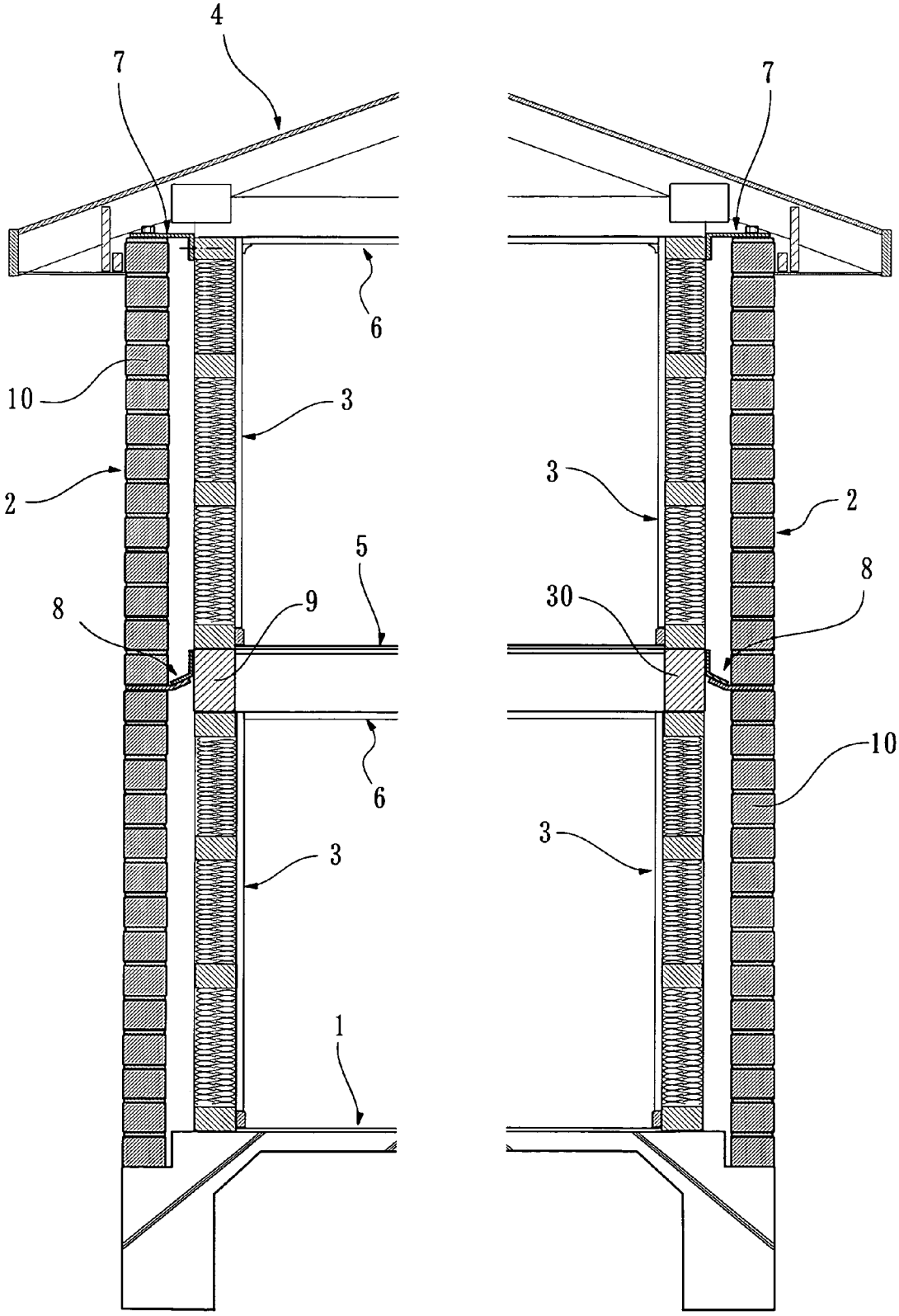
FIG. 1 is a schematic cross sectional view showing a house provided with the brick walls made by the DUP construction method.

FIG. 1 is a schematic cross-sectional view of a house provided with brick walls (brick wall structures) made by the DUP construction method.

The building is generally constructed from a foundation and floor slab 1, outer walls 2, inner walls 3, a second floor structure 5, ceilings 6, a roof structure 4 and roofing materials (not shown). The outer wall 2 consists of a brick wall which has bricks 10 laid in accordance with the DUP construction method. The inner wall 3 is constructed from wooden panels which are used in a two-by-four construction method, and it is built on the foundation and floor slab 1. The roof structure 4 is supported by an upper edge of the inner wall 3, and the roofing materials are provided on an upper surface of the roof structure 4. A load of the roof structure 4 acts on the inner wall 3 as a vertical load, which is supported by a load carrying capacity of the inner wall 3.

An outer end portion of a shearing reinforcement metal 7 is secured to an upper end portion of the outer wall 2, and the metal 7 extends horizontally toward the inner wall 3. An inner end portion of the metal 7 is bent downward at a right angle and connected to the upper end portion of the inner wall 3. The horizontal load (seismic force and so forth) acting on the roof structure 4 and the inner wall 3 is transmitted to the outer wall 2 by means of the metal 7 and it is supported by resistance of the outer wall 2 against earthquake. The second floor structure 5 and the upstairs inner wall 3 are supported by horizontal members 9. Shearing reinforcement means 8 for an intermediate floor 7 interconnects the horizontal members 9 and the outer wall 2 for transmission of stress.

Figure 2:
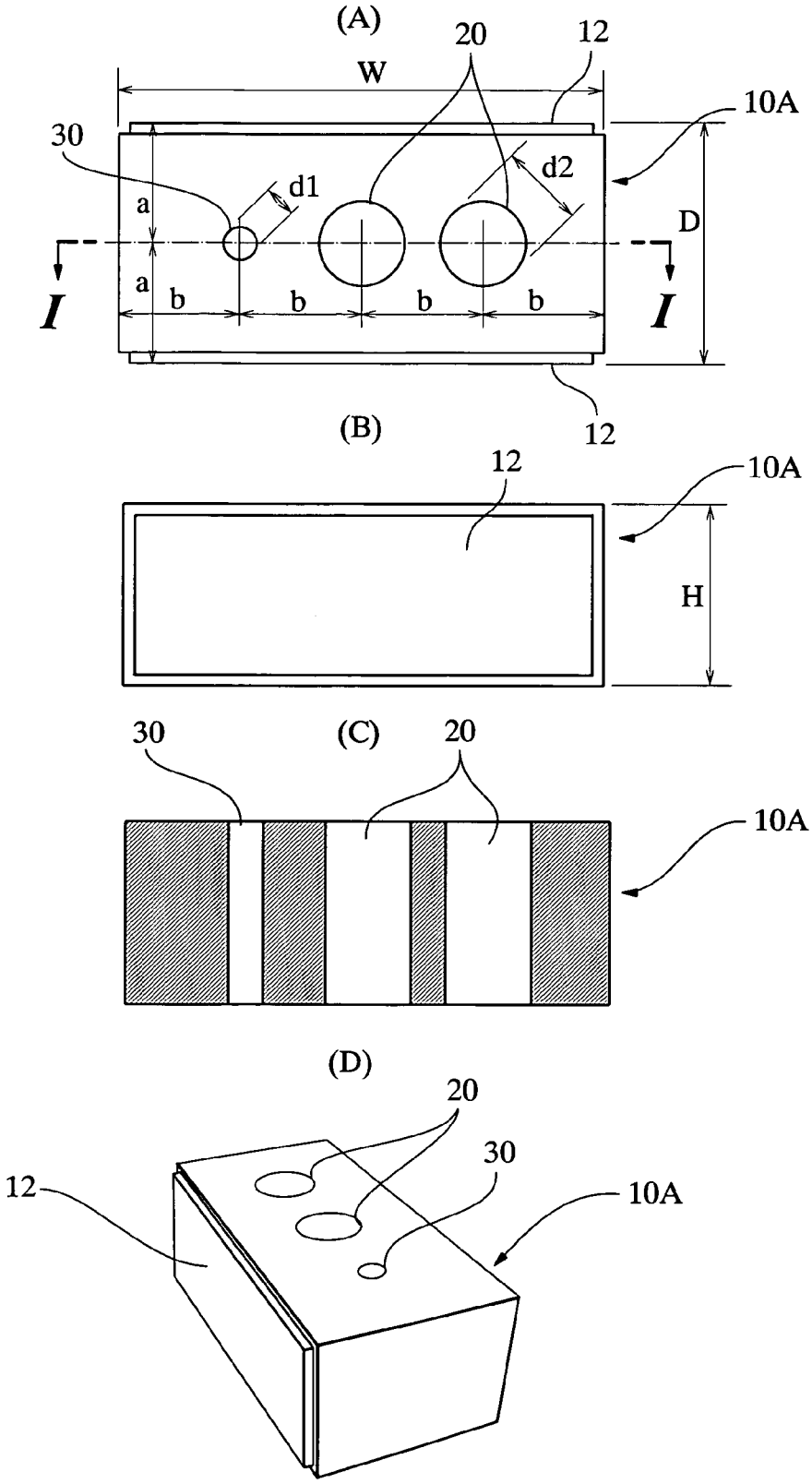
FIG. 2 is an illustration showing a plan, a front elevation, a cross-section taken along line I-I and a perspective view of a brick constituting an outer wall.
Figure 3:
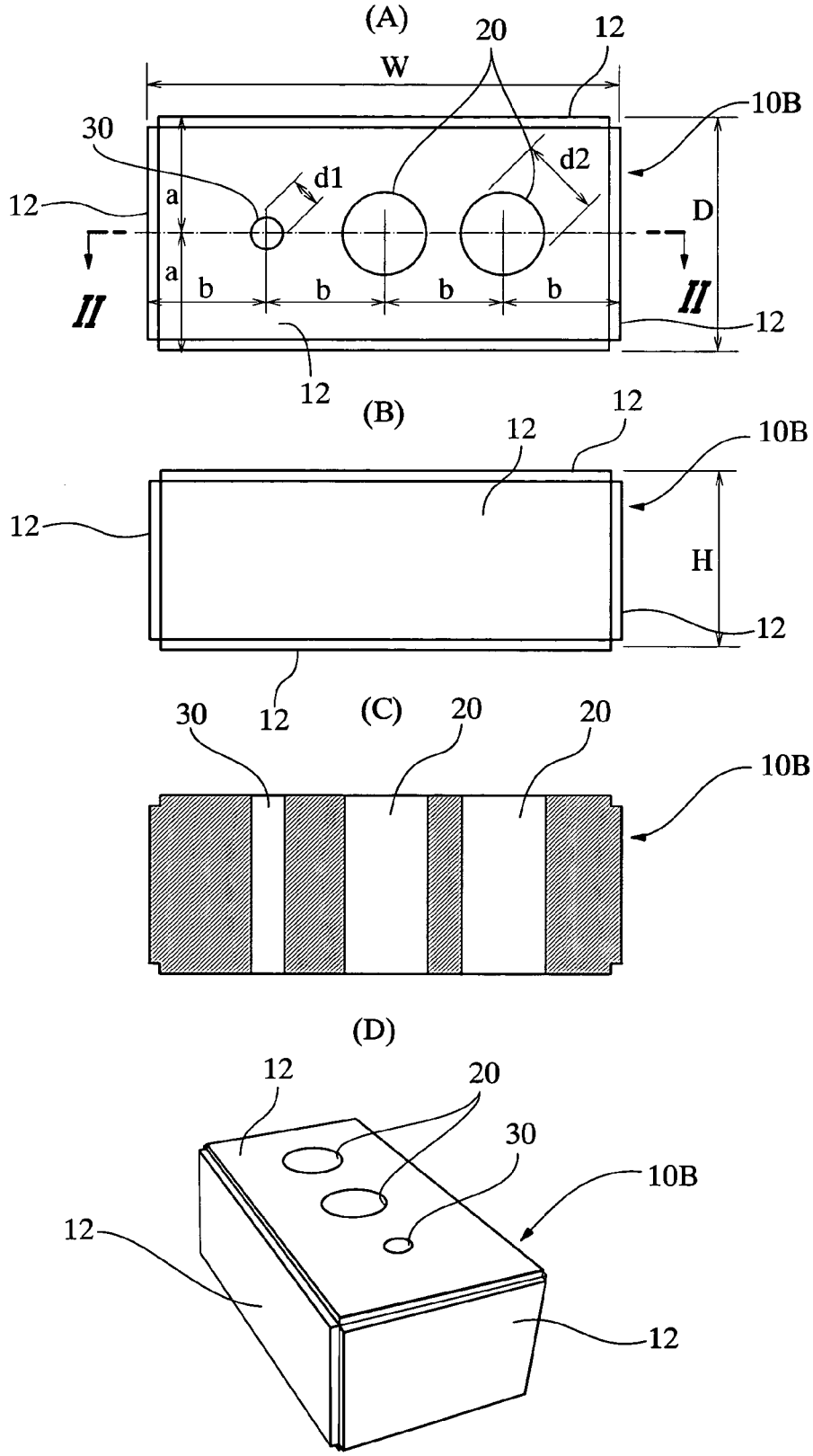
FIG. 3 is an illustration showing a plan, a front elevation, a cross-section taken along line II-II and a perspective view of another brick constituting the outer wall.

FIGS. 2 and 3 are illustrations of two types of bricks, each showing a plan, a front elevation, a cross-section and perspective views of the brick. FIGS. 4, 5, 6 and 7 are cross-sectional views, perspective views and an elevational view, which show a bricklaying method.

The first brick 10A as shown in FIG. 2 is an integrally formed product made from clay by high temperature baking, which is configured generally in a form of rectangular prism. The brick 10A is provided with a raised portion 12 on its front and rear faces. Vertical large diameter hollow sections 20 and a vertical bolt hole 30, each having a circular cross-section, are aligned in a widthwise direction of the brick 10A, and they vertically extend through the brick 10A, respectively. Each of centers of the large diameter hollow sections 20 and the bolt hole 30 is positioned on a center line of the brick 10A, and the centers are spaced an equal distance (b) from each other in a direction of the width (W) of the brick 10A. The bolt hole 30 is positioned at a center of one half part of the brick 10A (the left half as seen in the figure), and the hollow section 20 is positioned at a center of the other half part of the brick 10A (the right half as seen in the figure).

The second brick 10B as shown in FIG. 3 is a brick in a form of rectangular prism, which is produced by the same raw material and the same method as those of the first brick 10A. Similarly to the first brick 10A, the second brick 10B is provided with the vertical large diameter hollow sections 20 and the vertical bolt hole 30 having circular cross-sections, which are aligned on the center line and spaced an equal distance from each other. The bolt hole 30 is positioned at a center of one half part of the brick 10B (the left half as seen in the figure), and the hollow section 20 is positioned at a center of the other half part of the brick 10B (the right half as seen in the figure), in the same manner as that of the brick 10A. The brick 10B differs from the first brick 10A in that the raised portions 12 are provided on its front, rear, both end, top and bottom faces, respectively.

The dimensions (mm) of the bricks 10A, 10B, the bolt hole 30 and the hollow section 20 in this embodiment are set to be as follows:

Width W, Depth D and Height H of the brick; 220 mm×110 mm×85 mm

Locations a, b of the centers of the bolt hole and the hollow section; 55 mm, 55 mm Diameter d1, d2 of the bolt hole and the hollow section; 16 mm, 40 mm As is apparent from these values of size, the brick 10A, 10B have a proportion of an aspect ratio of 1:2 (planar dimensional ratio), and its half part has a square configuration in the plan view.

Figure 4:
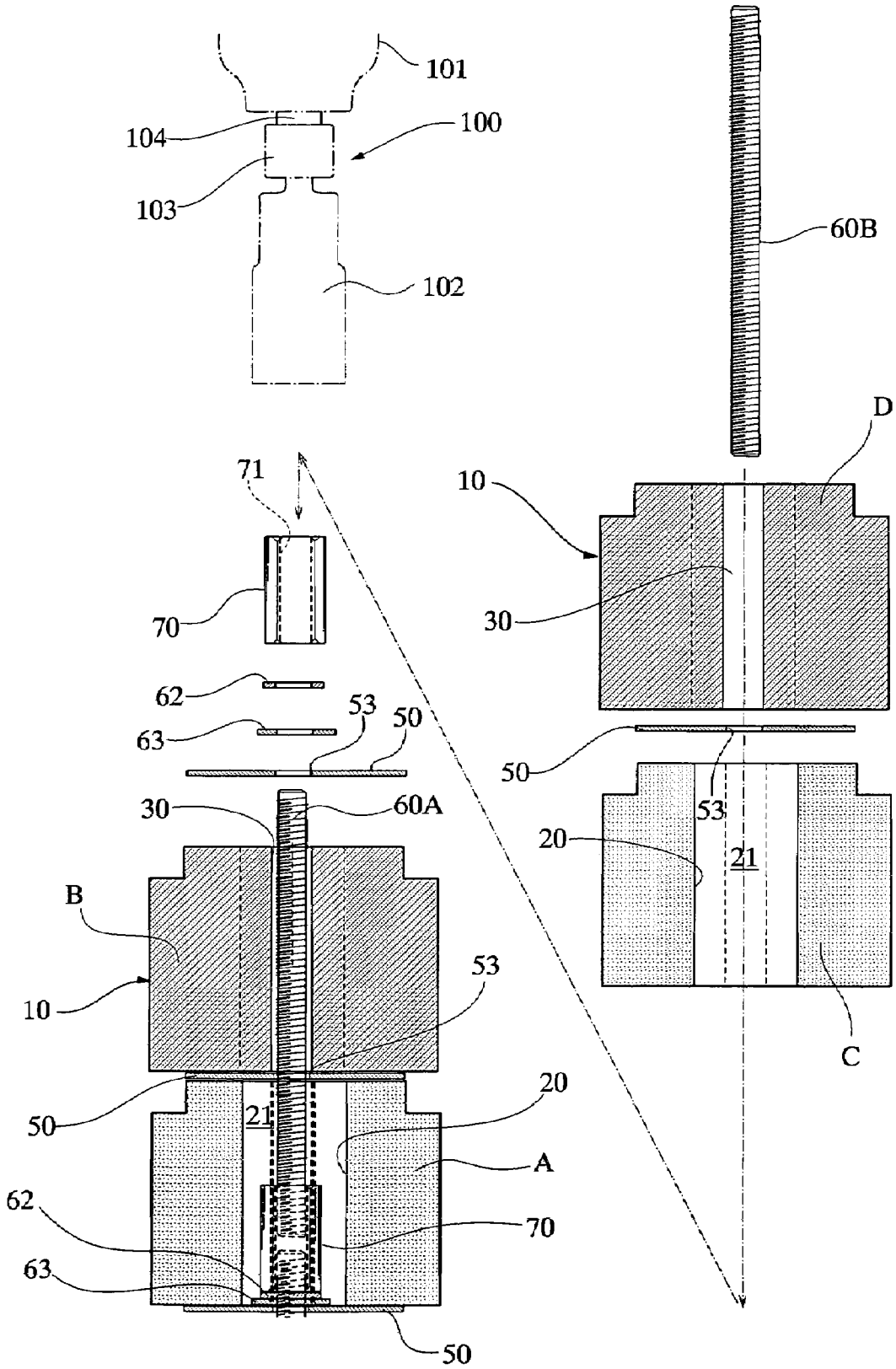
FIG. 4 is a vertical cross-sectional view showing a bricklaying process.

Steps of a bricklaying work are shown in FIG. 4. As shown in FIG. 4, a metal plate 50 is interposed between a first layer A of the bricks 10 and a second layer B thereof. Bolt holes 53 of the plate 50 are in alignment with the hollow section 20 and the bolt hole 30. A fully screw-cut bolt 60A, which has a height (length) equivalent to the height of two-layered bricks, extends through the hollow section 20 and the bolt holes 30, 53, and a long nut 70 engageable with the bolt 60A is positioned in a hollow area 21 of the hollow section 20. A lower end portion of the bolt 60A is screwed into the nut 70 and tightened thereto.

The plate 50 is positioned on an upper surface of the brick 10 (the first layer A; the second layer B) which has been already laid in position, and a circular washer 63 and a spring washer 62 are positioned on the plate 50 so as to be in alignment with the bolt hole 53. The bolt 60A extends through the bolt hole 53 and the washers 63, 62 to protrude upwardly, and an inside screw 71 of the nut 70 is screwed on an upper end portion of the bolt 60A.

A specific fixing tool 100 as illustrated by phantom lines in FIG. 4 is used for tightening the nut 70 onto the bolt 60A. The fixing tool 100 is provided with a portable driving part 101, a socket part 102 selectively engageable with the bolt 60 and the nut 70, and a joint part 103 which can integrally connect the proximal portion of the socket 102 with a rotary shaft 104 of the driving part 101. The socket part 102 receives the nut 70 so as to transmit the torque of the part 101 to the nut 70, thereby rotating the nut 70 in its tightening direction. The nut 70 rotates relatively to the bolt 60A to be securely tightened on the upper end portion of the bolt 60A.

In a succeeding bricklaying step, the brick 10 for an upper layer (the third layer C) is further laid on the lower layer brick B. The nut 70 is contained in the hollow section 20, and the metal plate 50 is laid on the brick 10 of the third layer C, and then, the bricks 10 of a further upper layer (the fourth layer D) are laid on the plate 50. A bolt 60B is inserted into the bolt hole 30 of the uppermost brick 10 (the fourth layer D), and the lower end portion of the bolt 60B is screwed into the nut 70. The aforementioned fixing tool 100 is used for tightening the bolt 60B to the nut 70. That is, the socket part 102 of the tool 100 receives the upper end portion of the bolt 60B to transmit the torque of the driving part 101 to the bolt 60B, so that the bolt 60B is rotated in its tightening direction. As the result, the bolt 60B is securely tightened to the nut 70.

Figure 5:
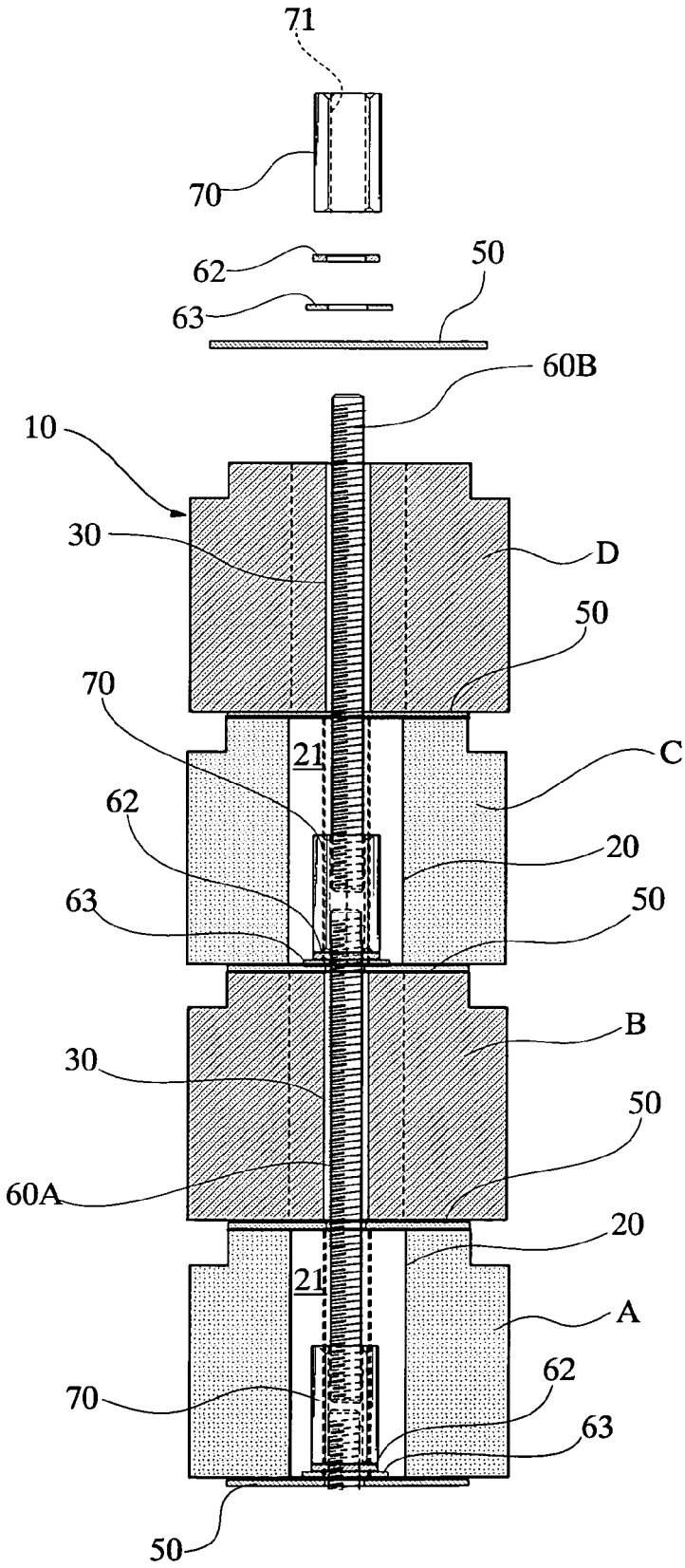
FIGS. 5 and 6 are illustrations showing a vertical cross-sectional view, a perspective view and an elevational view of a brick wall structure constructed by the bricklaying process as shown in FIG. 4.
Figure 6:
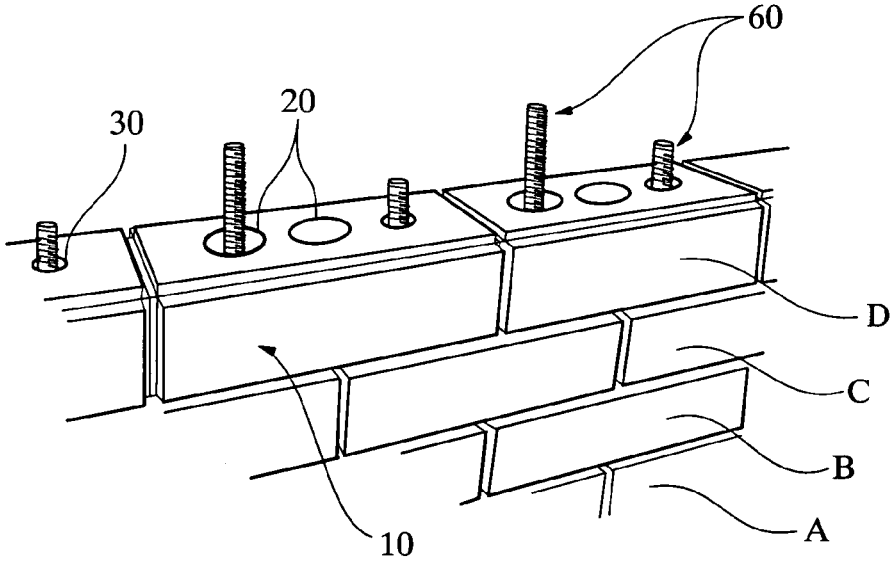
Figure 6:
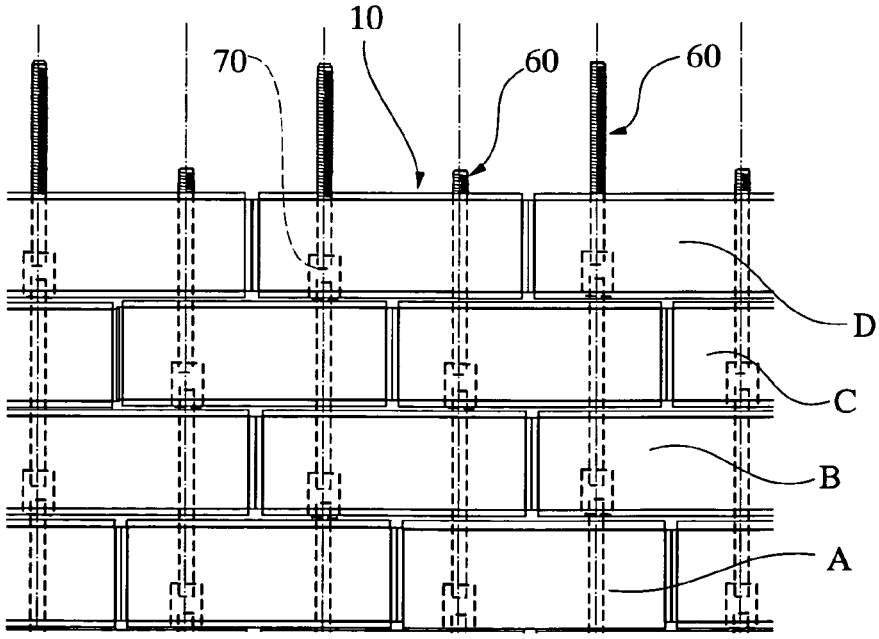
Figure 7:
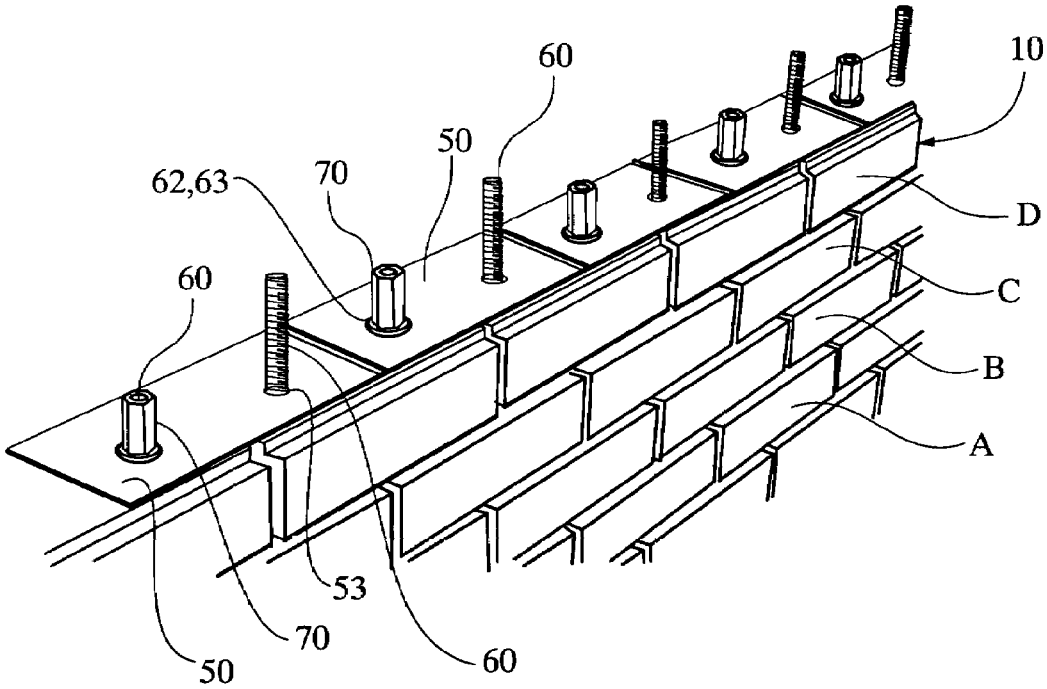
FIG. 7 is an illustration showing a perspective view of a condition that metal plates are laid on an upper face of the brick wall as shown in FIGS. 5 and 6, and horizontal cross-sectional views of the bricks of an even number layer and an odd number layer.
Figure 7:
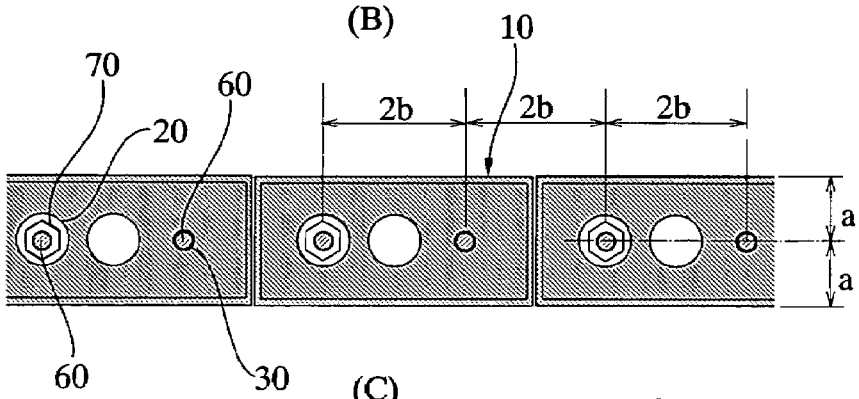
Figure 7:
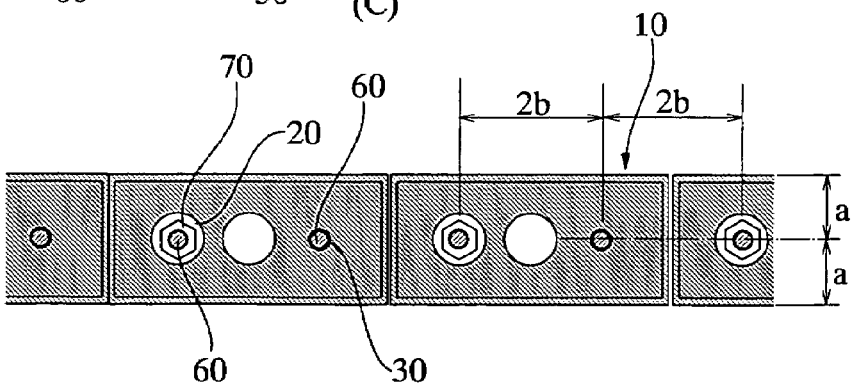

The brick-laid condition of the bricks 10 (the first to fourth layers A:B:C:D) thus constructed is shown in FIGS. 5 and 6. Tensile stress corresponding to the tightening torque acts as pre-stress on the bolt 60, upper and lower end portions of which are engaged with the nuts 70, and compressive stress acts as pre-stress on the brick 10 between the upper and lower plates 50. The torque applied to the bolt 60 and the nut 70 in the upper layer by the tool 100 transmits to the bolt 60 and the nut 70 of the layer immediately thereunder, and acts to further tighten the underside bolt and nut. Therefore, a series of connected bolts 60 and nuts 70 functions in such a manner that the tightening torque of the upper bolts 60 and nuts 70 is transmitted to the lower bolts 60 and nuts 70, and that the lower bolts 60 and nuts 70 are further tightened by a stronger tightening torque as the bricks 10 are laid in the upper layers. This results in that the pre-stress of a considerably high strength acts on the bolts 60 and the bricks 10 residing in the lower layers, and therefore, that the rigidity and toughness of the wall are considerably improved against the horizontal and vertical exciting forces.

FIG. 7(A) is a perspective view showing the steps of further assembling the plate 50, the washers 63, 62 and the nut 70 on the brick 10 of the fourth layer D. The steps as shown in FIG. 4 are repeatedly carried out for the upper layers above the bricks C:D, whereby a continuous wall (an outer wall or an interior partition wall of a building) having a dry construction type of bricklaying structure is constructed, which comprises the bricks integrally tightened by the fastening elements 60; 62; 63; 70.

FIG. 7(B) is a horizontal cross-sectional view showing an array of bricks in an even number layer B, D, whereas FIG. 7(C) is a horizontal cross-sectional view showing an array of bricks in an odd numbered layer A, C. As illustrated in the respective views, the nut 70 inserted into the hollow section 20 and the bolt 60 inserted through the bolt hole 30 are spaced apart an equal distance (2*b*) from each other and are alternately arrayed on the center line of the brick wall.

If desired, horizontal and vertical joints formed between the upper and lower bricks 10 or between the horizontally adjacent bricks 10 are filled with joint filler such as a sealing compound.

Figure 8:
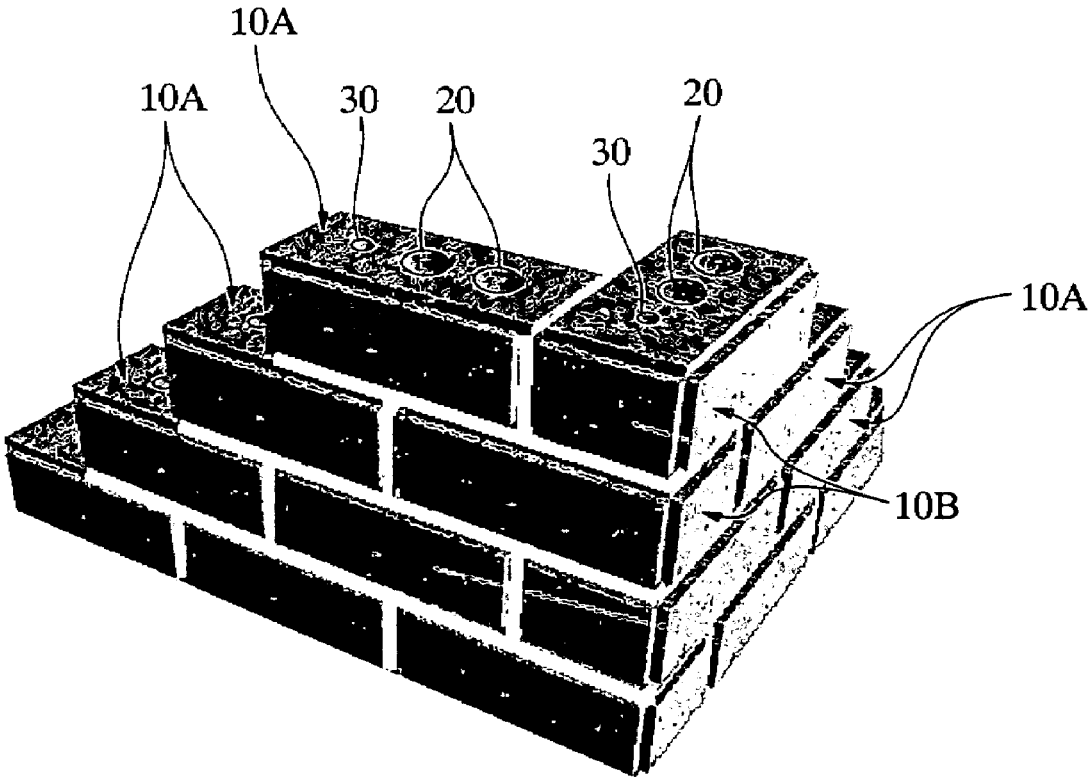
FIG. 8 is a perspective view exemplifying an arrangement of the bricks in a corner part of the brick walls.
Figure 9:
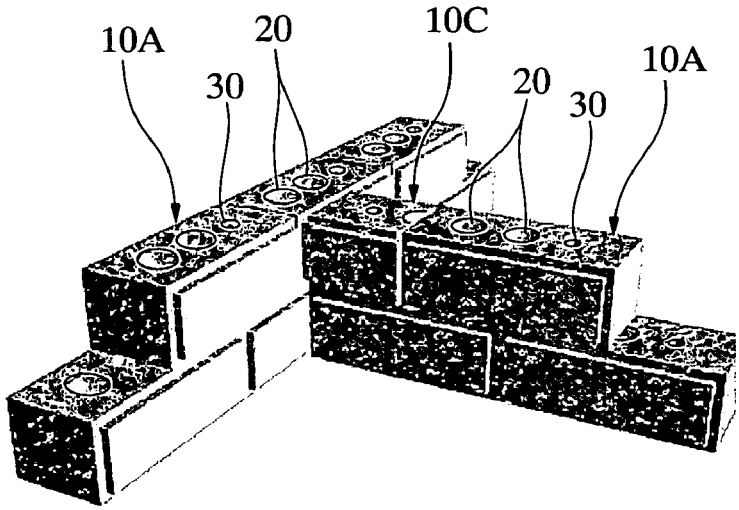
FIG. 9 is a perspective view exemplifying an arrangement of the bricks in a T-shaped connection of the brick walls.
Figure 10:
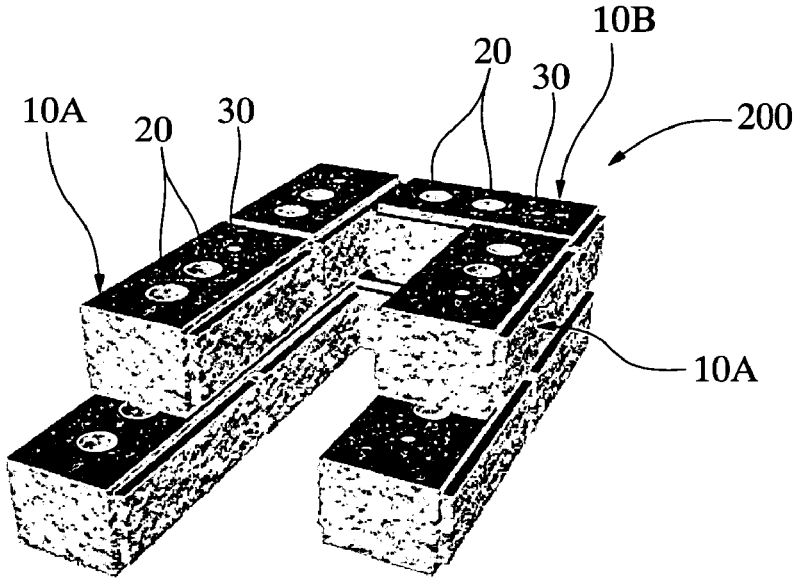
FIG. 10 is a perspective view exemplifying an arrangement of the bricks surrounding an opening of a door or window.

FIG. 8 is a perspective view showing an arrangement of the bricks at a corner part of brick wall, FIG. 9 is a perspective view showing an arrangement of the bricks at a T-shaped connection of brick walls, and FIG. 10 is a perspective view showing an arrangement of the bricks around an opening 200 for a door, window or the like.

As shown in FIG. 8, the corner of brick wall has a structure in which the bricks 10B (FIG. 3) oriented at a right angle are alternately laid. The hollow section 20 and the bolt hole 30 of the bricks 10B are vertically alternately arrayed. Straight bricklaying walls constructed from the bricks 10A (FIG. 2) extend at a right angle from the corner part.

In FIG. 9, a wall joint part is exemplified, in which straight bricklaying walls constructed from the bricks 10A (FIG. 2) are connected to each other in a form of letter "T". Generally, half bricks 10C are used at the joint part of the intersecting walls.

In FIG. 10, a wall structure surrounding the opening 200, such as an opening for a window or a door, is exemplified. The brick wall around the opening has an irregular arrangement in which the bricks 10A (FIG. 2) and the bricks 10B (FIG. 3) at a right angle are appropriately incorporated.

Figure 11:
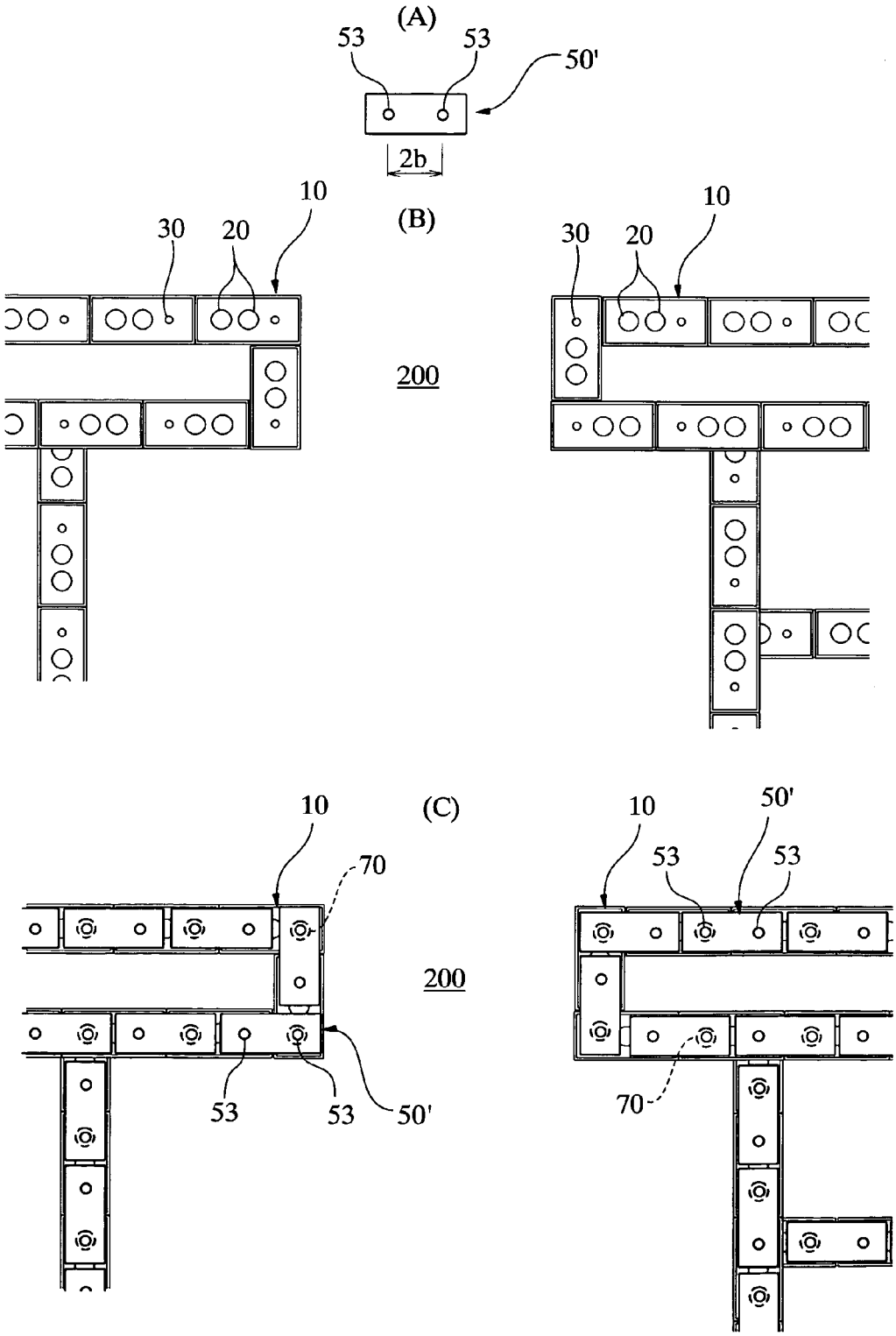
FIG. 11 is an illustration showing plans which exemplifies an arrangement of the two-holes plates in the brick wall having the wall connection and the opening of the door or window.
Figure 12:
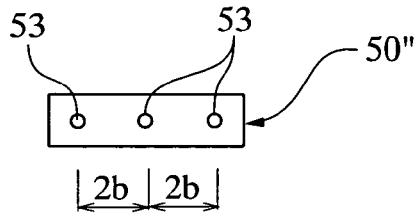
FIG. 12 is an illustration showing plans which exemplifies an arrangement of the three-holes plates in the brick wall having the wall connection and the opening of the door or window.
Figure 12:
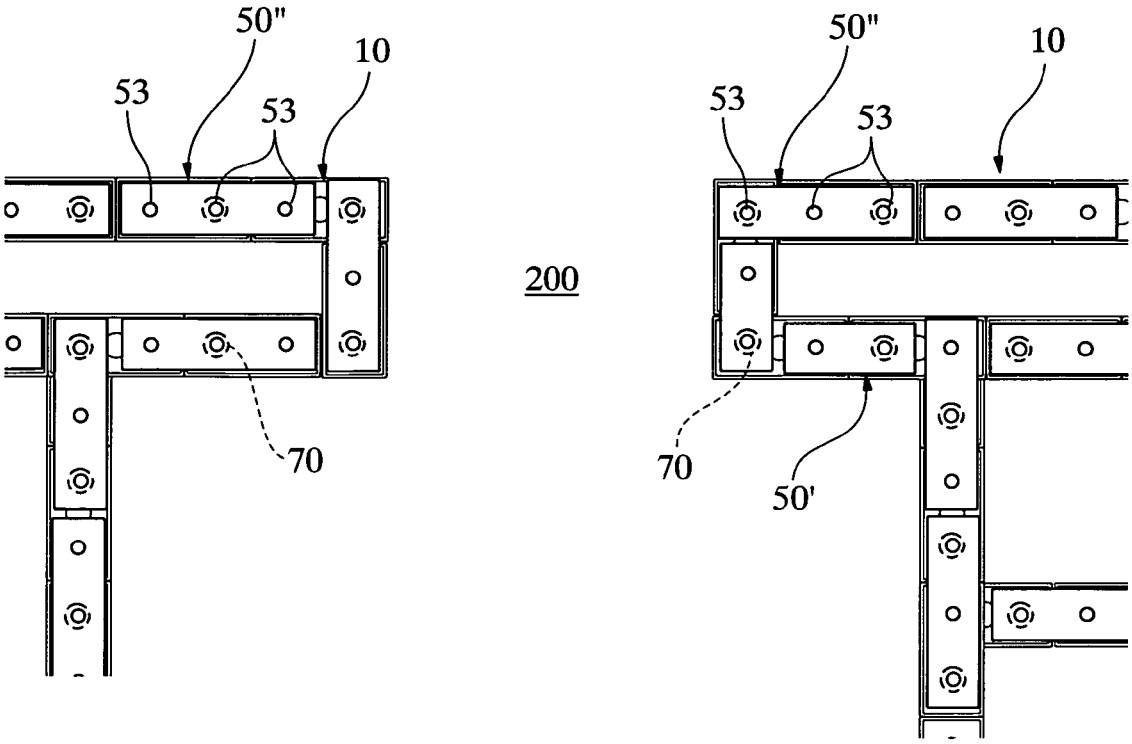

FIGS. 11 and 12 are plan views showing arrangements of the metal plates 50 in a brick wall provided with such a wall joint part and an opening for a door or window as set forth above.

A two-holed plate 50' having a pair of holes 53 is shown in FIG. 11(A), and a three-holed plate 50" having three holes 53 is shown in FIG. 12(A). A condition is illustrated in FIG. 11(C) in which the plates 50' are disposed on the brick wall as shown in FIG. 11(B), and a condition is shown in FIG. 12(B) in which the plates 50" are mainly disposed on the brick wall as shown in FIG. 11(B). Basically, each of the metal plates 50 are arranged so as to extend over at least two bricks 10.

The bolt hole 30 of the brick 10 should be located below at least one bolt hole 53 of the plate 50', 50", and the nut 70 should be tightened to the upper end portion of the bolt 60 extending through this bolt hole 53. However, if the types of metal plates 50 are limited to, e.g., only two types (the plates 50', 50"), it would be difficult to easily determine proper locations of the plates and proper positions of the bolts in the parts having a peculiar or deformed configurations, such as the openings 200 for doors or windows, projected or recessed corners of interior partition walls (interior walls), or the like.

Figure 13:
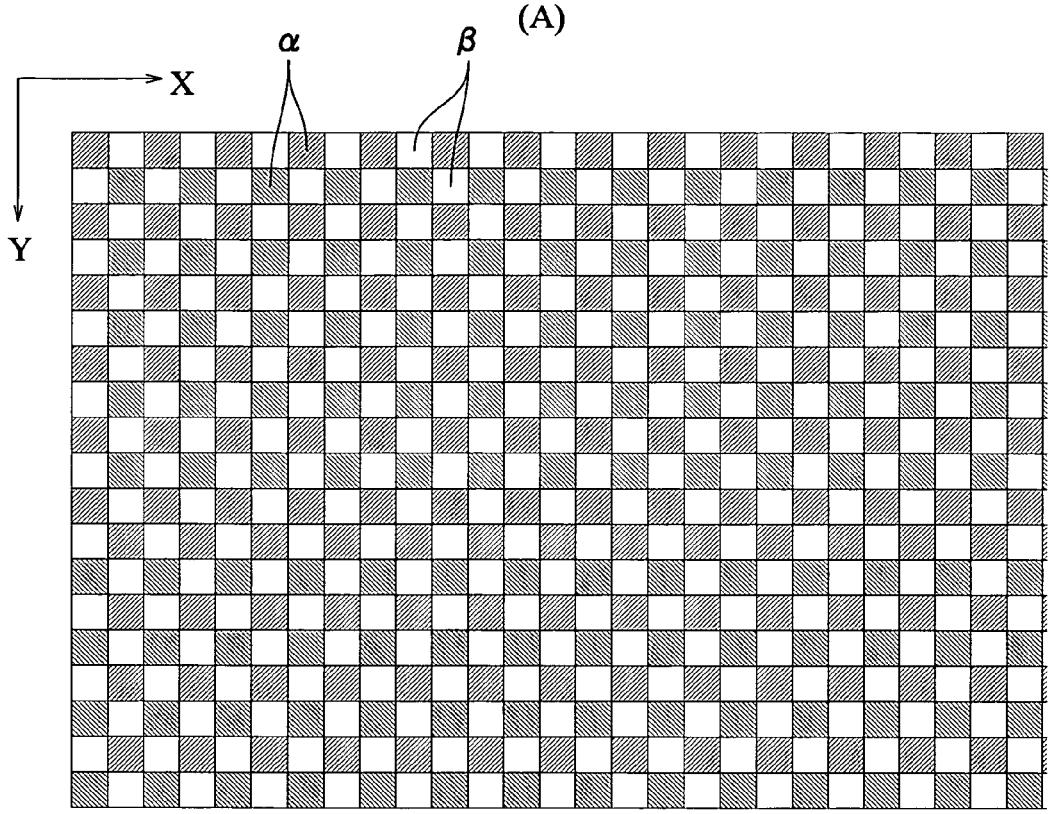
FIG. 13 is an illustration showing a plan and a partially enlarged plan of a grid plane in which square grids constituting the odd number layer tightening grids and the even number layer tightening grids are alternately arranged lengthwise and crosswise.
Figure 13:
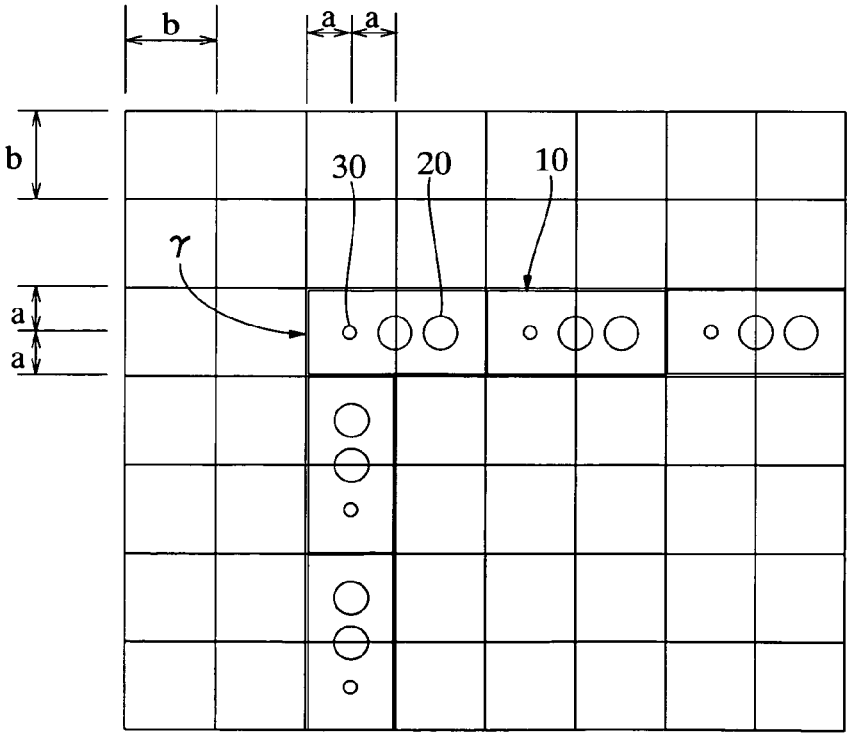

FIG. 13(A) is a plan view illustrating an XY coordinate system for systematical and accurate setting of positions of the bricks, the metal plates and the bolt and nut. FIG. 13(B) is a partially enlarged view of the XY coordinate system as shown in FIG. 13(A). It may be understood or comprehended that this XY coordinate system is a template for accurately positioning the bricks, the metal plates and the bolt and nut.

An X-axis and a Y-axis of the XY coordinate system intersect at a right angle, and a large number of square grid units are defined in the coordinate system by the lines extending in X-axis and Y-axis directions, each of the grid units having dimensions of one half of the brick 10, i.e., $D \times W/2 = 2a \times 2b$ (in this embodiment, 110 mm×110 mm). The square grid units are classified into odd number layer tightening grids $\alpha$ and even number layer tightening grids $\beta$. The grids $\alpha$, $\beta$ are alternately positioned in the X-direction and the Y-direction respectively, and a checkered grid pattern is dimensionally uniformly formed over the whole coordinate system.

As a corner part of the brick wall is positioned at an arbitrary grid $\gamma$ as shown in FIG. 13(B), allocation of the bricks, allocation of the plates and positioning of the bolts can be set systematically for the overall building, on the basis of the grid $\gamma$.

Figure 14:
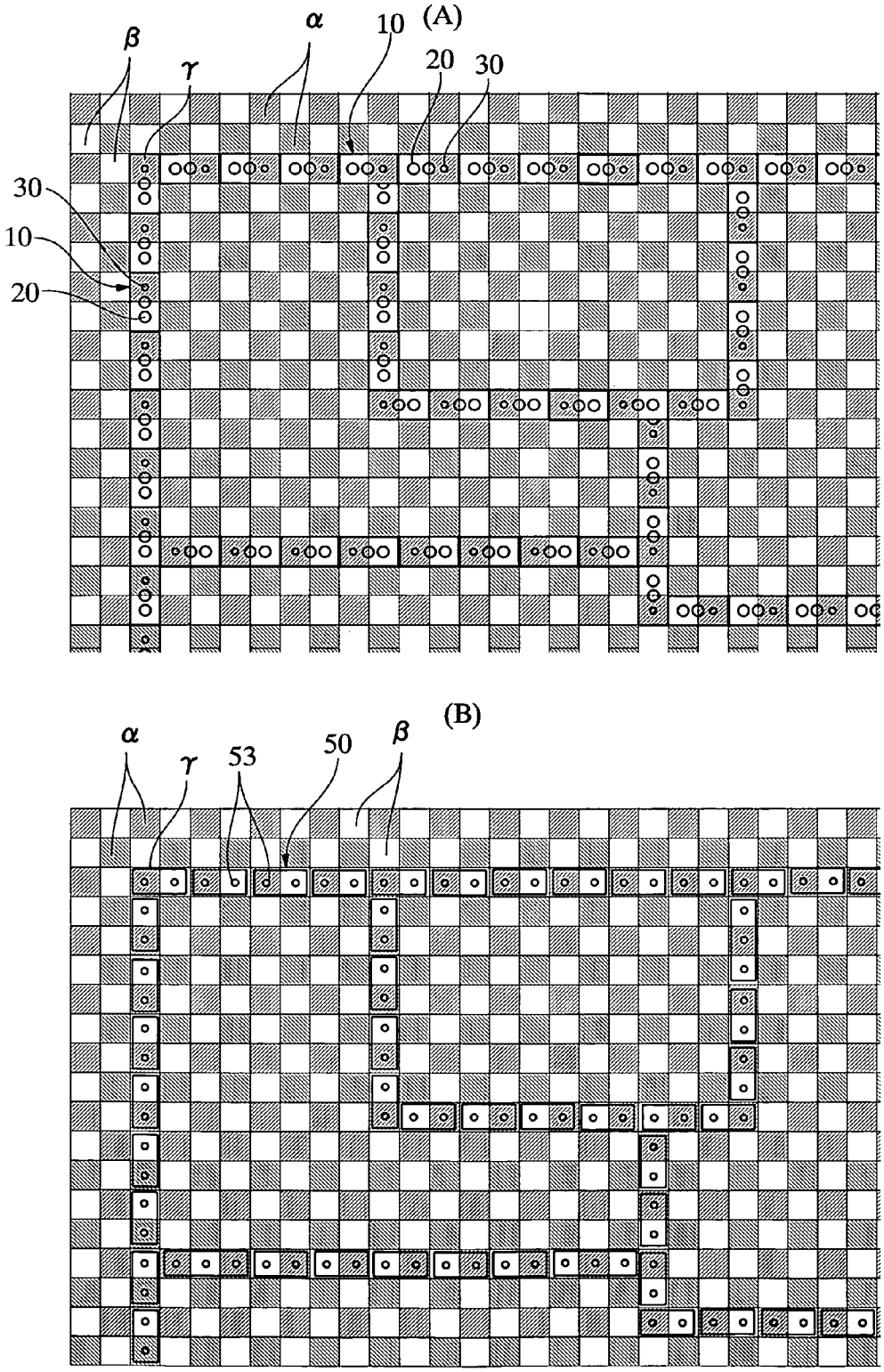
FIG. 14 is an illustration showing grid plans which exemplifies a process of allocating the bricks and the metal plates to be located in the odd number layer.
Figure 15:
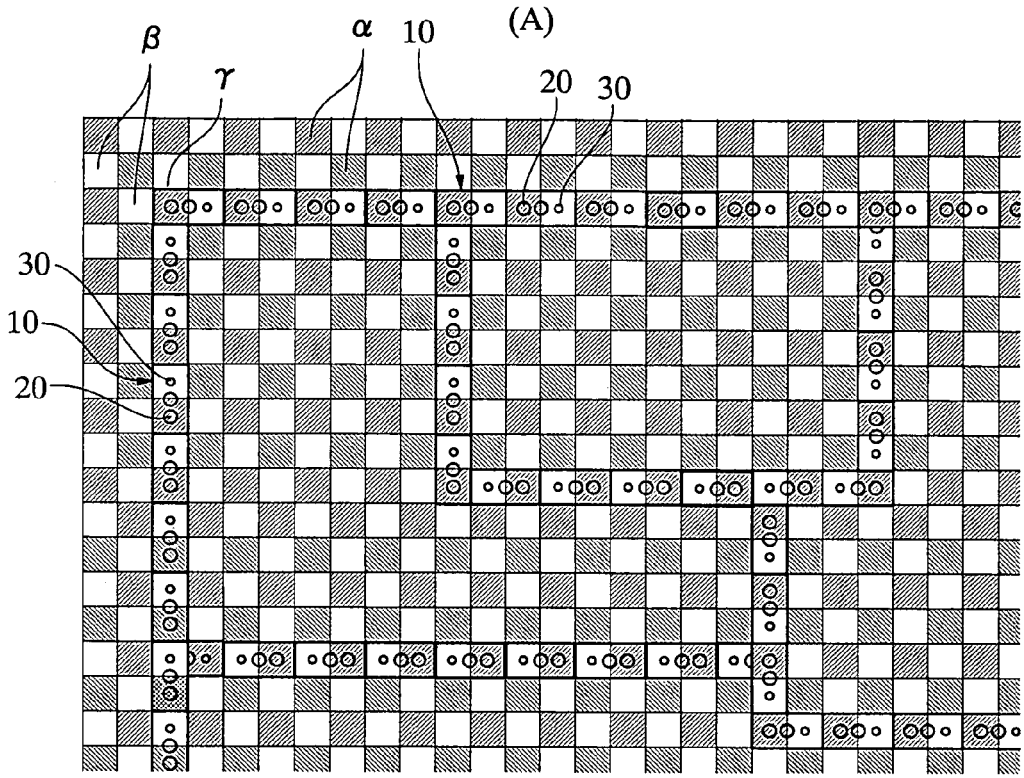
FIG. 15 is an illustration showing grid plans which exemplifies a process of allocating the bricks and the metal plates to be located in the even number layer.
Figure 15:
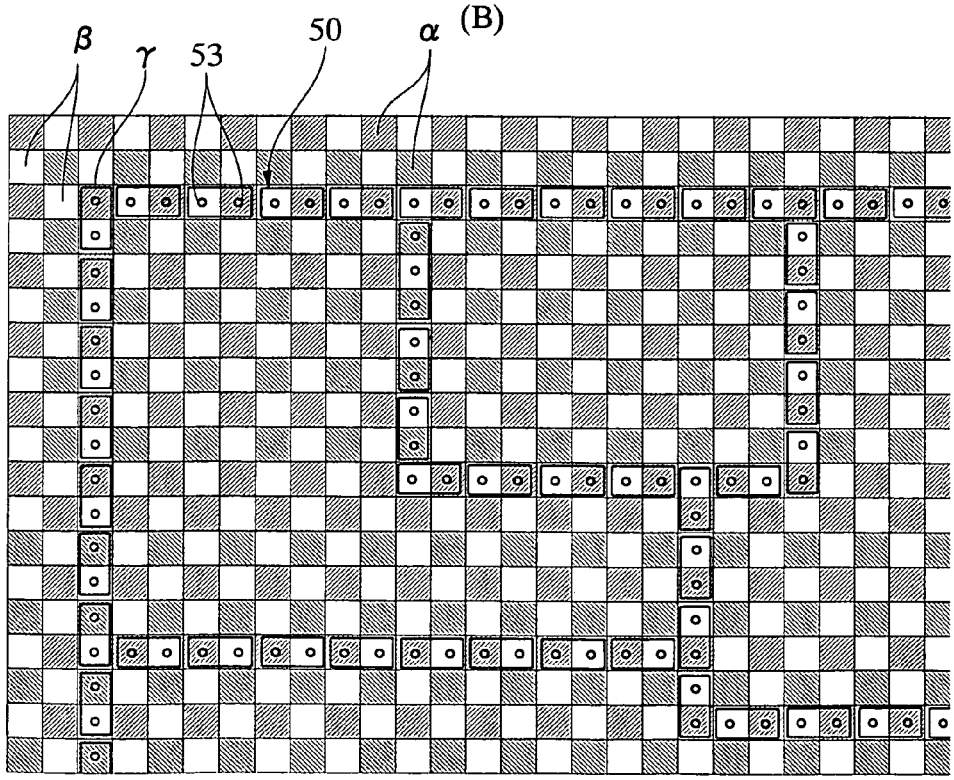

With reference to FIGS. 14 and 15, a method for making layout of the bricks and the plates is described hereinafter.

In FIG. 14, a process of allocating the bricks and the plates in the odd number layers such as the aforementioned bricks A; C (FIG. 6). In FIG. 15, a process of allocating the bricks and the plates in the even number layers such as the aforementioned bricks B; D (FIG. 6).

The allocation of the bricks in the odd number layers is carried out by allotting a corner of the brick wall to the reference grid $\gamma$ and successively allocating the bricks 10 in accord with a planning of the whole building, as shown in FIG. 14(A), whereby a layout plan or planar distribution map of the bricks corresponding to the building plan can be made in regard to the odd number layers. Simultaneously, the metal plates 50 are allocated successively from the reference grid $\gamma$ in correspondence to the layout plan of the bricks for the odd number layers as shown in FIG. 14(B), so that a layout plan or distribution map of the metal plates for the odd number layers is made in correspondence to the layout plan of the bricks for the odd number layers. In this embodiment, the two-holes plates 50' are mainly used as the metal plates 50.

The bricks 10 are allocated on the allocating condition that the bolt holes 30 are positioned at the odd number layer tightening grids $\alpha$. The metal plates 50 are allocated on the allocating condition that the metal plate 50 extends over the two bricks 10 and that at least one bolt hole 53 thereof is positioned in the odd number layer tightening grid $\alpha$.

As shown in FIG. 15(A), the allocation of the bricks in the even number layers is carried out by allotting the corner of the brick wall to the reference grid $\gamma$ and successively allocating the bricks 10 in accord with the planning of the whole building, similarly to the allocation of the bricks in the odd number layers, whereby a layout plan or planar distribution map of the bricks corresponding to the building plan is made in regard to the even number layers. The allocation of the bricks in the even number layer differs from that of the odd number layer in that the allocation is determined on the condition that the bolt holes 30 are disposed on the even number layer tightening grid $\beta$. Simultaneously, the metal plates 50 are allocated successively from the reference grid $\gamma$ in correspondence to the layout plan of the bricks for the even number layers as shown in FIG. 15(B), so that a layout plan or distribution map of the metal plates for the even number layers is made in correspondence to the layout plan of the bricks for the even number layers. The metal plates 50 are allocated on the allocating condition that the metal plate 50 extends over the two bricks 10 and that at least one bolt hole 53 thereof is positioned in the even number layer tightening grid $\beta$.

Figure 16:
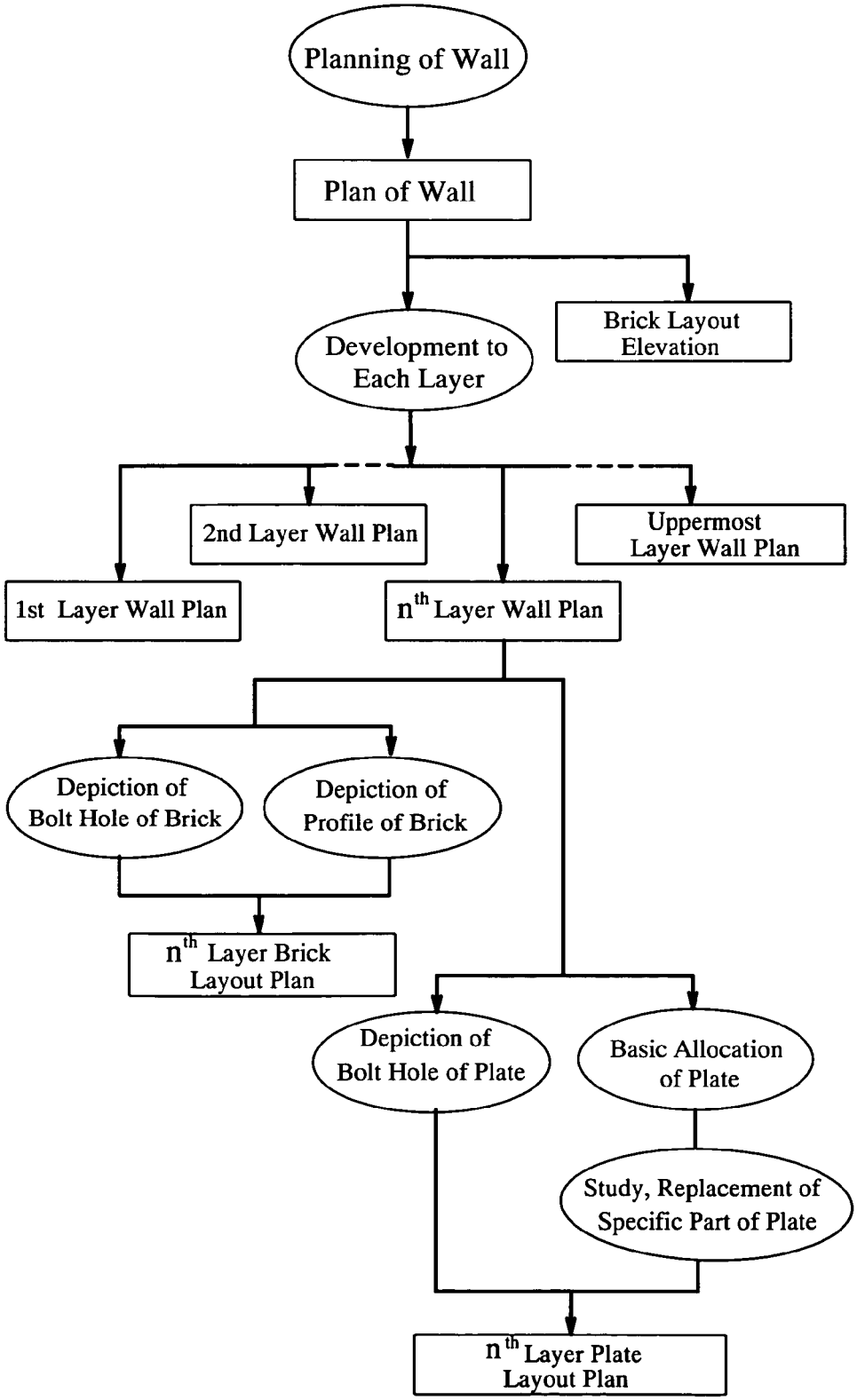
FIG. 16 is a flowchart showing steps of operation for systematically setting allocations of the bricks and the plates, and a layout of the bolts.

FIG. 16 is a flowchart showing the operation for systematically setting the allocation of the bricks, the allocation of the plates and the positions of the bolts for the whole building with use of the aforementioned coordinate system.

As a plan of the building is fixed by planning of the owner of the building, an architect and the like, positional information of the respective parts of the wall including information of openings and the like is applied to the aforementioned XY coordinate system, whereby an elevational brick layout is determined, and therefore, the elevational brick layout drawings can be drafted. Simultaneously, the wall plan is developed in each of the layers or steps for settling the wall plan of each layer or step including the brick layout information and the plate layout information. The bolt holes 30 in the odd number layer are positioned in the odd number layer tightening grids $\alpha$, whereas the bolt holes 30 in the even number layer are positioned in the even number layer tightening grids $\beta$. The profile of brick and so forth is determined. Thus, the brick layout plan in each of the layers can be made.

As regards the metal plates 50, the bolt holes 53 of the plates 50 in the odd number layers are positioned in the odd number layer tightening grids α, and the bolt holes 53 of the plates 50 in the even number layers are positioned in the even number layer tightening grids β, whereby the basic allocation of the plates 50 is made. If desired, study, replacement or the like are conducted with respect to specific parts of the plates. Thus, the plate layout plan can be made in each of the layers.

Programming of the flow of operation as shown in FIG. 16 is conduced by information processing technology, and if desired, cooperation or plug-in with a drafting software, such as a CAD software, whereby a computer program for allocation and a brick allocating system specialized to the DUP construction method can be made with respect to the bricks, the plates and the bolts. Further, quantities of the bricks, the plates, the bolts and so on required for construction of the building can be automatically estimated by information processing of the various data of such a computer program for allocation.

Figure 17:
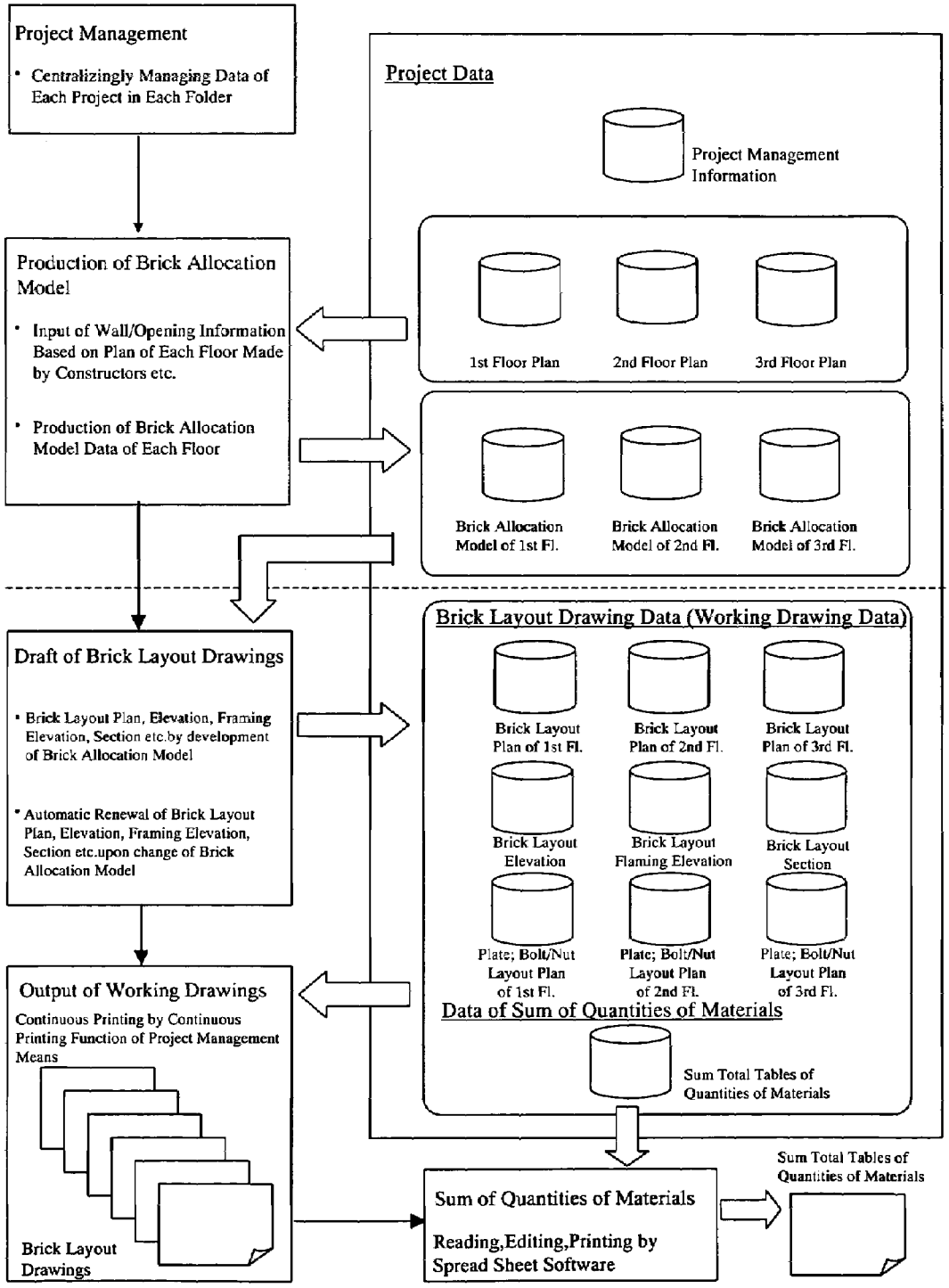
FIGS. 17 and 18 are a logic diagram and a system schematic diagram of a brick allocating system carrying out the construction planning method according to the present invention.
Figure 18:
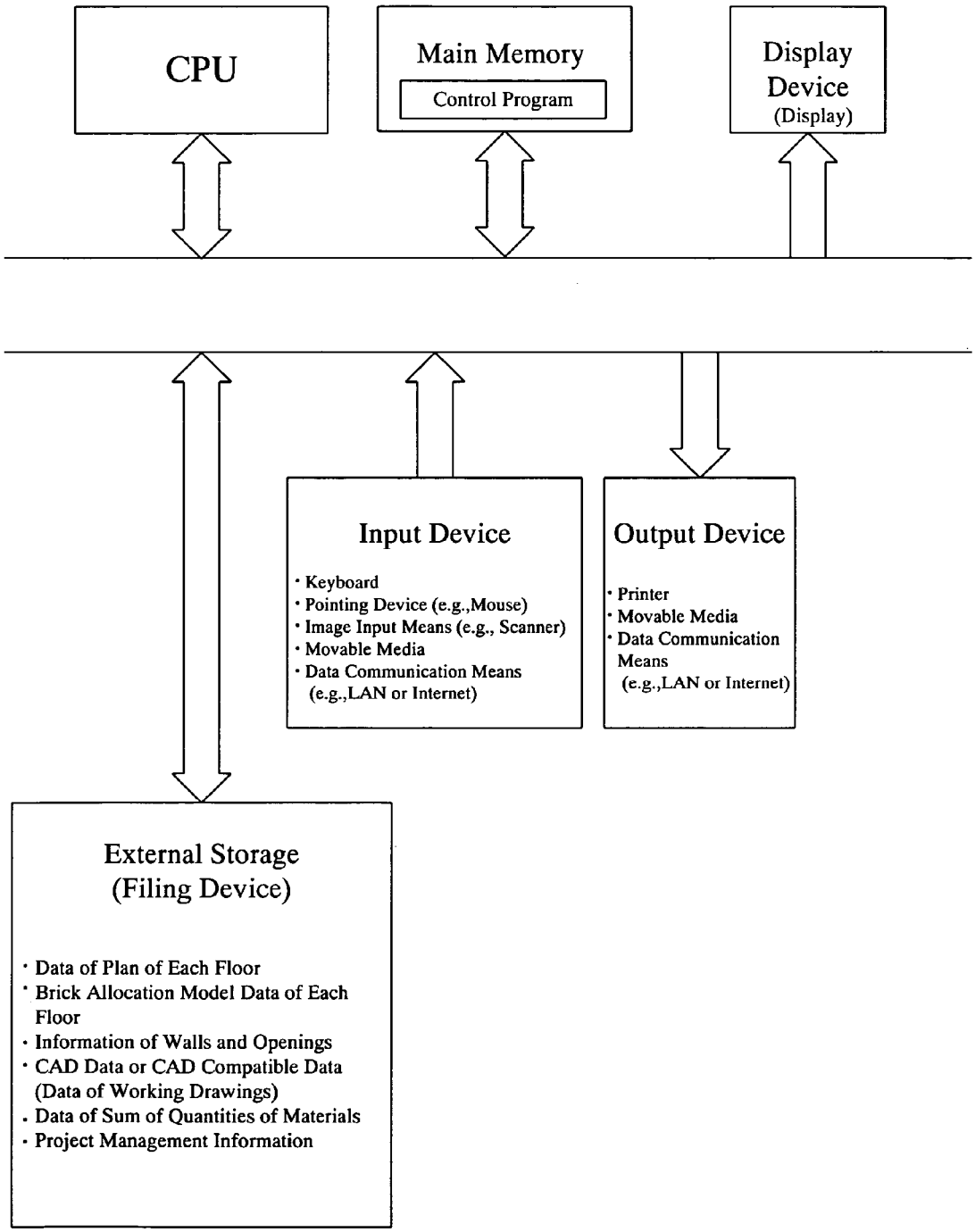
Figure 19:
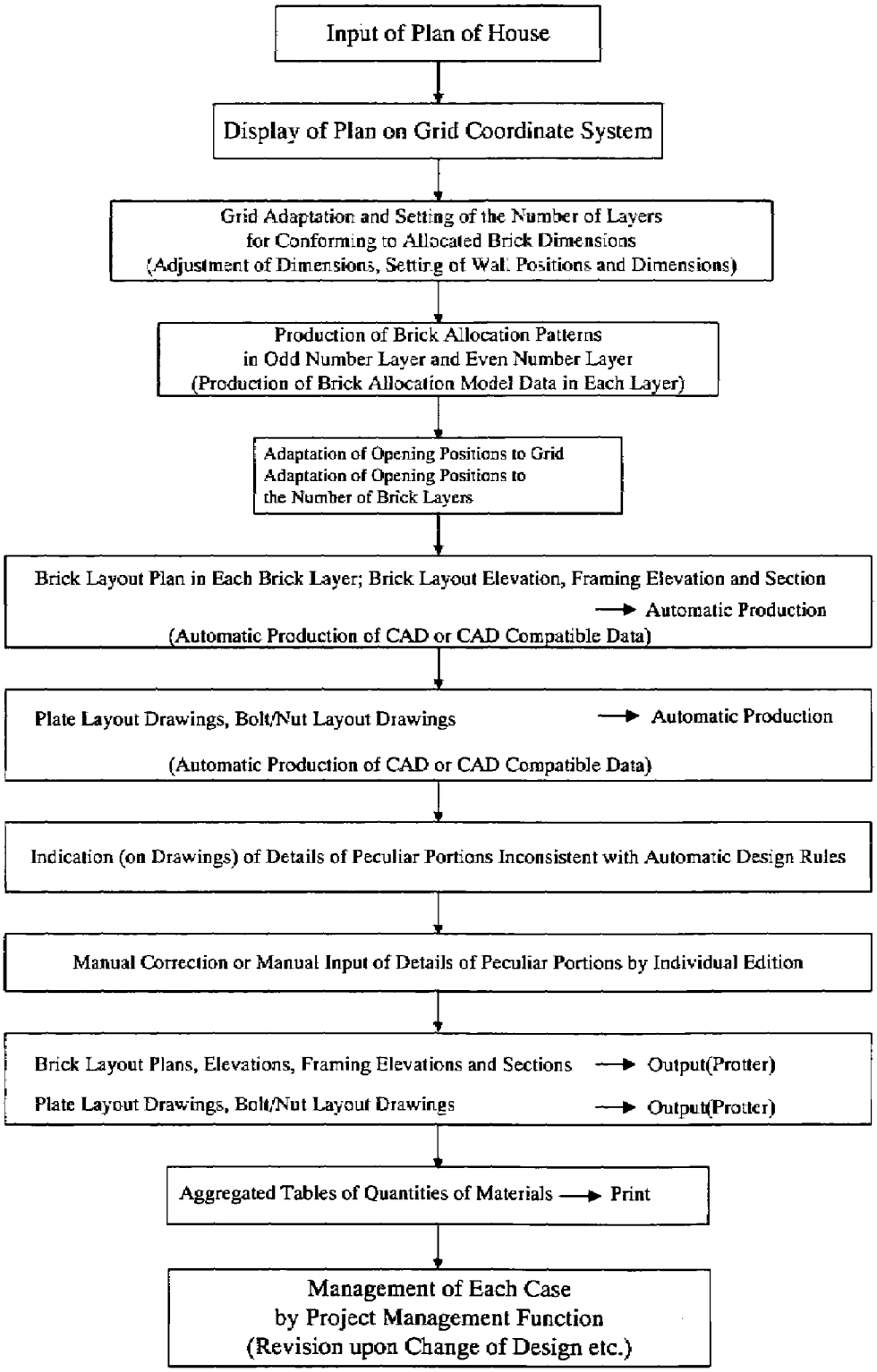
FIG. 19 is a flowchart showing processes performed by the brick allocating system.

FIGS. 17 and 18 are a logic diagram and a system schematic diagram of the brick allocating system which carries out the method (the method of construction planning, execution scheme or execution scheduling) according to the present invention. FIG. 19 is a flowchart which shows the processes carried out by the brick allocating system.

As shown in FIG. 17, the brick allocating system comprises project management means, means for producing a brick allocation model, means for drafting brick layout drawings, means for outputting working drawings, and means for summing quantities of materials. The project management means manages various kinds of data produced for each of housing construction projects, in each of folders, and relates and associates the data with each other. The project management means also manages renewal histories, backup and access in regard to each of the data, and controls batch output (continuous printing of drawings and so forth). Design drawings for a house (including at least a plan or plans) made by a builder, an architectural design office and the like are displayed on the grids as information of walls by the means for producing the brick allocation model. This enables grid adaptation and setting of the number of layers to be conducted by manual operation of the operator. The means for producing the brick allocation model makes data of the brick allocation model in the odd number layers and the even number layers throughout the overall height of wall, in accord with the grid adaptation operation and the layer number setting operation of an operator, wherein the model data correspond to the positions and planar dimensions of the walls on the design drawings. The means for producing the brick allocation model also enables input operation adapted for the grids and the number of brick layers in regard to positions and dimensions of openings such as windows and doors as indicated on the design drawings (information of openings). The positions and dimensions of openings (data of openings) after the grid adaptation and the brick layer number setting, are composed into the brick allocation model data by the means for producing the brick allocation model. The means for drafting brick layout drawings automatically drafts brick layout plans, elevations, framing elevations, sections and so forth, based on the brick allocation model data for the odd number and even number layers combined with the data of openings. Further, the means for drafting brick layout drawings automatically drafts layout drawings of the plates, layout drawings of the bolts and nuts, and so forth, based on the brick allocation model data. The means for outputting working drawings continuously prints out the various kinds of brick layout drawings (plans, elevations, framing elevations, and sections of the brick layout) made by the means for drafting brick layout drawings, under control of the project management means, as being the working drawings. The means for summing quantities of materials sums up the quantities of bricks, plates, bolts, nuts and so forth, and prints out the aggregated total in a form of sum total tables of quantities of materials. The various kinds of data files produced in the processes as set forth above are stored in the same folder by the project management means, which manages these data files with use of a hierarchical structure defined by a basic OS (Operating System □ of the computer.

With reference to FIGS. 18 and 19, operation of the brick allocating system is specifically described hereinafter.

The brick allocating system can be embodied by a widely used PC (Personal Computer). As shown in FIG. 18, a CPU (Central Processing Unit), a main memory, an external storage, an input device, an output device, and a display device are connected to each other by a bus structure. A program for allocating the bricks, which is made by specifically programming the method for planning the construction of a brick wall according to the present invention, is previously installed to the PC, and the program is memorized as a control program by the main memory at the time of bootstrap. The CPU and the main memory (after memorizing the control program) constitute a data processing system which produces and composes various kinds of data.

The plan of house made by a builder or the like is inputted to the PC through a network or communication means, such as Internet, Intranet, LAN (Local Area Network), an FD, a MD, a ZIP, or an external HDD, or an image capturing device such as a scanner.

The CPU (Central Processing Unit) stores the plan of a house (the original drawing) in the external storage (a file system) such as a built-in HDD, and displays the plan and the grid coordinate system on a computer display in response to commands of the control program of the main memory. The grid coordinate systems are displayed on the display device as illustrated on FIGS. 13 to 15 in conditions that the plan is overlaid on the grid coordinate systems. In general, the architectural module for designing a house does not conform to a multiple of a dimensional unit of a brick (220(110)×110×85), and therefore, operations are required for coordinating the wall positions and dimensions of the house plan with the grids. These operations includes a grid adaptation operation of the wall positions and the wall dimensions by adjusting the dimensions, and a setting operation of the number of brick layers in correspondence to the height of the wall. The grid adaptation operation and the setting operation of the number of brick layers are carried out by manual operations of the operator with use of a pointing device such as a mouse and a keyboard. As the result of such a grid adaptation operation, the wall positions and the wall dimensions indicated on the plan of the house (the original drawing), i.e., the wall structure information is adjusted to be the planar positions and the planar dimensions adapted for the grids on the display device, as illustrated on FIGS. 14(A) and 15(A). As the result of such a setting operation, the wall structure information is set to be the wall height suitable for the unit dimension of the brick. Further, the CPU determines brick allocation patterns for the odd number layer and the even number layer in response to the commands of the control program, and stores the patterns in the external storage as being a brick allocation model data. Such data processing and data storage are carried out for each floor of the house, so that the brick allocation model data and the plans of house (the original drawings) for the respective floors are stored in the external storage.

Then, information of the positions and the dimensions of openings (windows, doors and the like) on the design drawings made by the builders or the like (information of openings) is inputted to the brick allocation models in such a manner that it is adapted for the grids and the number of brick layers. The grid adaptation operation and the brick layer numbers setting operation for the positions and dimensions of the openings are carried out by manual operations of the operator with use of the pointing device and the keyboard, as in the aforementioned operations for the walls. As the result of inputting such information of the openings, the planar positions of openings as indicated on the plans of house (the original drawings) are specified in the brick allocation models so as to be adapted for the grids on the display device, and the elevational positions (upper ends and lower ends) of openings are specified in the brick allocation models so as to be adapted for the number of grid layers. The positions and dimensions of the openings specified in the brick allocation models are stored in the external storage as data of openings adapted for the brick allocation.

The CPU incorporates the data of openings to the brick allocation models in response to the commands of the control program. The CPU automatically makes brick layout plans for the respective brick layers, based on the brick allocation models after the incorporation, and also, automatically makes brick layout elevations, framing elevations (elevations in which only bricks are depicted), and sections. The brick layout plans, elevations, framing elevations and sections are stored in the external storage as CAD (Computer Aided Design) data or CAD compatible data.

At the same time, the CPU determines positions of the metal plates to be inserted between the bricks, and positions of the bolts and nuts for fastening the bricks, and then, automatically makes layout drawings of the plates and layout drawings of the bolts and nuts, as shown in FIG. 14(B) and FIG. 15(B). These layout drawings are stored in the external storage as CAD data or CAD compatible data.

The CPU checks peculiar portions which does not fall under the automatic allocating rules (brick allocating rules, and positioning rules of plates, bolts and nuts) which are set in the control program, and indicates such peculiar portions on the drawings. Indications of these peculiar portions are made by, e.g., depicting circles surrounding the peculiar portions or presenting the peculiar portions by a specific color. As this kind of peculiar portion, a part of the wall having an opening extremely close to an end, a corner or an intersection of the wall or walls, where suitable positioning of the metal plates is difficult, or a joint part of the walls having the center lines of the walls slightly offset, is exemplified. Empirically, it is assumed that such a portion would appear very often in actual houses.

This kind of irregular part (peculiar portion) is indicated on the display device and the operator manually corrects or input the allocation of bricks and the positions of plates, bolts and nuts in such a part by individual editing. After revision of the peculiar parts by manual correction or input, CAD data or CAD compatible data of the brick layout plans, elevations, framing elevations and sections; layout drawings of plates; and layout drawings of bolts and nuts are stored in the external storage as data of working drawings.

The data of working drawings are continuously printed out from an output device such as a plotter by the operator's manipulation of the pointing device and keyboard. The printed working drawings are delivered to the builders, the architectural design office, the construction site or the like. Media, in which the working drawings are stored as CAD data or CAD compatible data, may be furnished to the builders or the like. The data of the working drawings may be transmitted thereto through communication means.

The CPU automatically estimates the quantities of materials such as bricks, plates, bolts and nuts in accordance with commands of the control program. The automatic estimation is carried out by automatically integrating the respective materials from the data of working drawings and automatically summing them in the form of a table. Data of quantities of the respective materials are quickly processed and summed up by plug-in or cooperation of a spread sheet software. The operator can print out aggregated tables of quantities of materials from an output device such as a printer by manipulation of the pointing device or the keyboard. If desired, the control program is arranged so as to set functional formulas of the quantities of materials and man-hours, functional formulas of the quantities of materials and the quantities of subsidiary materials, and the like, and the CPU automatically calculates the man-hours, the quantities of subsidiary materials, and the like, in response to the commands of the control program. In a case where the control program has such an arrangement, the operator can print out the man-hours, the quantities of subsidiary materials and the like from the output device by manipulation of the pointing device and the keyboard.

The control program instructs the CPU to store in the external storage or the main memory, the project management information for managing the various kinds of data stored in the external storage. The aforementioned kinds of data are stored in the external storage, whenever design and construction projects of houses are performed, and large amounts of data are stored in the external storage. However, the project management means centrally manages the various kinds of data for the respective projects in each of the folders, and renders the data to be in relation to and in cooperation with each other. If any change is made to the design drawings (original drawings) of the house which are initial data, the brick allocation model is revised, whereby the layout plans, framing elevations, sections and elevations; the layout drawings of the plates; the layout drawings of the bolts and nuts; and the results of estimation can be automatically revised by their linking with the revised brick allocation model. The data after revision can be output as set forth above.

The project management means also functions as means for recording histories of revision of the design, and acts as a resource of information for management of each of the houses during construction and after construction. This enables the project history information for quality control, control of construction period, and the like, to be promptly supplied to the construction sites, the builders, the architectural design offices, the owners of buildings, and so forth.

As set forth above, according to the aforementioned method (grid method) for allocating the bricks, plates and bolts with use of the grid plan, allocation and so forth for the bricks 10, plates 50, bolts 60 and nuts 70 can be determined accurately, simply, promptly and systematically before construction or during construction by means of the odd number layer tightening grids $\alpha$ in the odd number layers and the even number layer tightening grids $\beta$ in the even number layers. In accordance with such a grid method, optimized design with use of a few types of metal plates can be performed by means of systematic and simple human work or mechanical work, and therefore, the types of metal plates can be restricted. Thus, standardized production of the metal plates and stock of them are possible. Further, use of the aforementioned grid method allows substantially all of the bolts and nuts to be contained in the hollow sections 20 and the bolt holes 30 of the bricks 10, and therefore, weather resistance, fire resistance and the like of the bolts and nuts are improved. In addition, the bolts and nuts are uniformly distributed over the entire brick walls, so that the effects of tightening forces of the bolts and nuts can be uniformly given to the overall walls.

Although the present invention has been described as to specific embodiments, the present invention is not limited to such embodiments, but may be modified and changed without departing from the scope of the invention as claimed in the attached claims.

The invention claimed is:

1. A method implemented using a data processing system including a processor, a main memory, and a control program residing in the main memory, for planning an arrangement of bricks for the construction of a brick wall made by a dry type of construction method, in which the brick wall is constructed from bricks, bolts, nuts and metal plates and in which the bricks are integrally assembled under pre-stress by tightening forces of the bolts and nuts, wherein the brick has a planar dimensional proportion which is 1:2 in an aspect ratio, a bolt hole with a diameter smaller than an external diameter of said nut vertically extends through a center of a first square half part of said brick, a hollow section for containing the nut vertically extends through a center of a second square half part of said brick, and said bolt has an overall length for fastening the vertically adjacent two bricks, comprising the steps of:

specifying a grid pattern XY coordinate system forming a number of square grid units, each of the grid units substantially conforming to a planar size of the square half part of said brick, and setting odd number layer tightening grids ($\alpha$) and even number layer tightening grids ($\beta$) alternately in each of X- and Y-directions, using the data processing system;

setting an arbitrary grid unit, to which an end part of the brick wall is allotted, to be a reference grid ($\gamma$), using the data processing system;

positioning the brick of the end part of the brick wall on said reference grid for allocating the bricks in the odd number layer so as to match said first square half part to said odd number layer tightening grid, and successively arraying the bricks of the odd number layer from the brick on the reference grid, as well as positioning the brick of the end part of the brick wall on said reference grid for allocating the bricks in the even number layer so as to match said first square half part to said even number layer tightening grid, and successively arraying the bricks of the even number layer from the brick on the reference grid, using the data processing system; and arraying said metal plates for allocation of the plates on the bricks of said odd number layer so that at least one bolt hole of the plate is positioned on said odd number layer tightening grid, as well as arraying the metal plates for allocation of the plates on the bricks of said even number layer so that at least one bolt hole of the plate is positioned on said even number layer tightening grid, using the data processing system.

2. A method as defined in claim 1, wherein said metal plate has two, three, four or five bolt holes, which are spaced from each other, a distance corresponding to the planar dimension of said square half part.

3. A method as defined in claim 1, wherein said nuts for the bricks of the odd number layer are allotted by the data processing system to the bolt holes of said metal plates located on the odd number layer, and the nuts for the bricks of the even number layer are allotted by the data processing system to the bolt holes of said metal plates located on the even number layer.

4. A method as defined in claim 1, wherein a corner of the brick wall is allotted to said grid by the data processing system, so that the said reference grid ($\gamma$) is determined.

5. A method as defined in claim 1, wherein quantities of the bricks, the bolts, the nuts and the metal plates are estimated by the data processing system, based on the number of grids locating along the brick wall.

6. A brick wall of a building which is constructed in accordance with the brick allocation and the plate allocation determined by the method as defined in claim 1, so that said bolts and nuts are contained in said bolt holes and said hollow sections.

7. A computer program product, comprising a computer usable medium having a computer readable program code embodied therein, said computer readable program code adapted to be executed to implement a method implemented using a data processing system including a processor, a main memory, and a control program residing in the main memory, for making a brick layout drawing for construction of a brick wall with respect to the brick wall made by a dry type of construction method, in which the brick walls are constructed from bricks, bolts, nuts and metal plates and in which the bricks are integrally assembled under pre-stress by tightening forces of the bolts and nuts, wherein the computer readable program code causes the computer to function as:

grid coordinate system display means for displaying on a display, a grid pattern XY coordinate system constituted from square grids, each corresponding to the planar size of a square half part of the brick;

brick allocation model production means implemented by the data processing system for producing brick allocation model data of an odd number layer and an even number layer which are adapted for said grids, based on information of a wall structure and an opening on an architectural design drawing inputted to said XY coordinate system;

brick layout drawing data production means implemented by the data processing system for automatically producing brick layout drawing data from said brick allocation model data; and drawing data output means for outputting said brick layout drawing data as a working drawing for construction.

8. A computer program product as defined in claim 7, wherein the readable program code further causes the computer to function as means for producing layout drawing data for allocating the bolts, the nuts and the metal plates, which automatically produces the layout drawing data of the bolts, the nuts and the metal plates on the basis of said brick allocation model data.

9. A computer program product as defined in claim 7, wherein said grid coordinate system display means causes the computer to display a plan of said architectural design drawing on the said XY coordinate system.

10. A computer program product as defined in claim 7, wherein the readable program code further causes the computer to function as material quantities summing means for summing up the quantities of the bricks, the bolts, the nuts and the metal plates on the basis of said brick allocation model data.

11. A computer program product as defined in claim 8, wherein the readable program code further causes the computer to function as individual revision means for displaying a peculiar portion inconsistent with a rule for automatically producing said brick layout drawing data in said brick layout drawing data production means, and enabling a manual revision or input of the allocation of the bricks, the bolts, the nuts and the metal plates in said peculiar portion.

12. A brick allocating system for making a brick layout drawing for construction of a brick wall with respect to the brick wall made by a dry type of construction method, in which the brick walls are constructed from bricks, bolts, nuts and metal plates and in which the bricks are integrally assembled under pre-stress by tightening forces of the bolts and nuts, comprising:

a display device for displaying a grid pattern XY coordinate system constituted from square grids, each corresponding to the planar size of a square half part of the brick;

an input device for inputting information of a wall structure and an opening on an architectural design drawing, to said XY coordinate system;

a data processing device producing brick allocation model data for an odd number layer and an even number layer, which are adapted for the grids, and automatically producing brick layout drawing data based on said brick allocation model data;

a storage device for storing said brick allocation model data and said brick layout drawing data; and an output device for outputting said brick layout drawing data as a working drawing for construction.

13. A system as defined in claim 12, wherein said data processing device automatically produces layout drawing data of the bolts, the nuts and the metal plates from said brick allocation model data;

said storage device stores said layout drawing data of the bolts, the nuts and the metal plates; and said output device outputs said layout drawing data of the bolts, the nuts and the metal plates as a working drawing for construction.

14. A system as defined in claim 12, wherein said data processing device sums up quantities of the bricks, the bolts, the nuts and the metal plates on the basis of said brick allocation model data;

said storage device stores the quantities of the bricks, the bolts, the nuts and the metal plates; and said output device outputs data of the quantities of the bricks, the bolts, the nuts and the metal plates.

15. A system as defined in claim 12, wherein said data processing device sets odd number layer tightening grids ($\alpha$) and even number layer tightening grids ($\beta$) alternately in each of X- and Y-directions; sets a grid unit on the XY coordinate system to which an end part of the brick wall is allotted, to be a reference grid ($\gamma$); successively arrays the bricks of the odd number layer from the brick on the reference grid in such a manner that a first half part of the brick with a bolt hole matches the odd number layer tightening grid; and successively arrays the bricks of the even number layer from the brick on the reference grid in such a manner that said first half part matches the even number layer tightening grid.

16. A system as defined in claim 13, wherein said data processing device arrays the metal plates of the odd number layer so that at least one bolt hole of the plate is positioned on said odd number layer tightening grid, and arrays the metal plates of the even number layer so that at least one bolt hole of the metal plate is positioned on said even number layer tightening grid.

* * * * *